United States Patent [19]

Vine

[11] 4,240,527

[45] Dec. 23, 1980

[54] ELEVATOR SYSTEM

[75] Inventor: James Vine, Pittsburgh, Pa.

[73] Assignee: Westinghouse Electric Corp., Pittsburgh, Pa.

[21] Appl. No.: 470,095

[22] Filed: May 15, 1974

Related U.S. Application Data

[63] Continuation of Ser. No. 340,619, Mar. 12, 1973, abandoned.

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,605,951 | 9/1971 | Kirsch | 187/29 |
| 3,682,275 | 8/1972 | Loshbough et al. | 187/29 |
| 3,739,880 | 6/1973 | Robaszkiewicz | 187/29 |
| 3,743,057 | 7/1973 | Hall et al. | 187/29 |

*Primary Examiner*—J. V. Truhe
*Assistant Examiner*—W. E. Duncanson, Jr.
*Attorney, Agent, or Firm*—D. R. Lackey

[57] ABSTRACT

An elevator system for a structure having a plurality of floors, including a plurality of elevator cars mounted in the structure to serve the floors. The elevator system performs a plurality of functions related to collecting floor or corridor calls, collecting car status and position data, allocating corridor calls to suitably conditioned elevator cars which are already in the process of serving calls for elevator service, creating a demand signal relative to a call which can not be so allocated, and assigning an available car not in the process of serving calls for elevator service to a call for which a demand signal was created. The various functions are performed as the need is indicated for them, with the sequence of their performance, when the need for more than one function is indicated, depending upon their relative urgencies. In one embodiment, certain of the functions are serially performed in a predetermined first loop until a demand signal is created and there is an available car which can be assigned to the demand call, which concurrent conditions establish a second loop which includes the function of assigning an available car to a demand call.

23 Claims, 30 Drawing Figures

FIG.12

INPUT WORDS FROM EACH CAR

| | 11 | 10 | 9 | 8 | 7 | 6 | 5 | 4 | 3 | 2 | 1 | 0 |
|---|---|---|---|---|---|---|---|---|---|---|---|---|
| IWO | AVAS | | $\overline{32L}$ | DRCL | CCBL | CCAB | CALL | UPSV | UPTR | INSC | BYPS | SLDN |
| IW1 | AVP6 | AVP5 | AVP4 | AVP3 | AVP2 | AVP1 | AVPO | | | | | |
| IW2 | | | | | | | | | $\overline{WT75}$ | $\overline{WT50}$ | CREG | ATSV |

FIG.13

OUTPUT WORDS TO EACH CAR

| | 11 | 10 | 9 | 8 | 7 | 6 | 5 | 4 | 3 | 2 | 1 | 0 |
|---|---|---|---|---|---|---|---|---|---|---|---|---|
| OWO | FAD6 | FAD5 | FAD4 | FAD3 | FAD2 | FAD1 | FADO | SASS | TASS | MODI | MODO | $\overline{PARK}$ |
| OW1 | | | HLMI | HLMO | | | $\overline{DCLO}$ | $\overline{DOPN}$ | $\overline{CCAI}$ | $\overline{MCCR}$ | | $\overline{BSMT}$ |
| OW2 | | | | | | $\overline{STT}$ | $\overline{MNFL}$ | $\overline{NEXT}$ | | | | |

FIG.14

EXTRA MEMORY WORD FOR EACH CAR

| 11 | 10 | 9 | 8 | 7 | 6 | 5 | 4 | 3 | 2 | 1 | 0 |
|---|---|---|---|---|---|---|---|---|---|---|---|
| BAS CAP | | | | MFS | BNXT | BCC | ASG | MFX | ——ZONE—— | | |

FIG.15

ZONE CODE

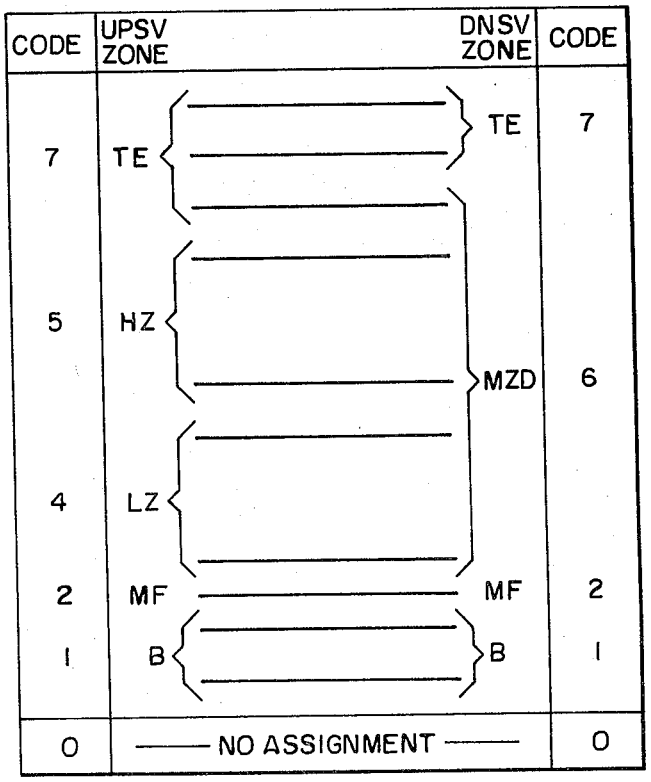

ELEVATOR SYSTEM

CROSS-REFERENCES TO RELATED APPLICATIONS

This is a continuation of application Ser. No. 340,619 filed Mar. 12, 1973, now abandoned.

Certain of the apparatus disclosed and described in this application, but not claimed, is claimed in the following concurrently filed applications:

Application Ser. No. 340,615, filed Mar. 12, 1973 in the name of M. Sackin, now U.S. Pat. No. 3,851,734 which is assigned to the same assignee as the present application.

Application Ser. No. 340,617, filed Mar. 12, 1973 in the names of M. Sackin and D. M. Edison, now U.S. Pat. No. 3,851,733 which is assigned to the same assignee as the present application.

BACKGROUND OF THE INVENTION

1. Field of the Invention

The invention relates in general to elevator systems, and more specifically to elevator systems having a plurality of cars controlled by a system processor.

2. Description of the Prior Art

Elevator systems of the prior art which have a plurality of cars controlled by a central dispatcher control system, commonly operate in one of a plurality of different modes, with the specific mode selected at any one time depending upon traffic conditions. The "events" which are detected by the control system to sense which mode the system should be operating in are generated by hardware, the decision making control for determining the operating strategy or mode is hardwired, and the system input signals are received and processed in parallel to generate parallel output signals for control of the various elevator cars.

A programmable dispatcher, including a digital computer and a software package for directing the computer hardware to the specific task of elevator car dispatching, would have many advantages over the conventional hardwired dispatcher control system. For example, with the decision making and operating mode strategy confined to the software package, the hardware car controller and car station for the individual cars may be substantially identical for each elevator installation. The specific strategy employed for each installation would be tailored according to its requirements, and later changed, if desired, without modification of the hardware. For example, changes in the usage of a particular building which require a different strategy for the associated elevator system than that originally employed, may be easily changed when the strategy is in the form of software, by making the desired changes in the software program and storing the new program in the memory of the computer.

The change from a hardwired dispatcher to a programmable one, however, is not as straightforward as might be expected. Hardwired dispatchers have many logic elements, enabling them to process signals in parallel. With a digital computer, the number of logic elements is severely restricted, necessitating sequential processing of signals. Each input signal must, therefore, be observed in turn, and each output signal generated in turn. To remove the need for precise timing of input and output signals, which would complicate the program and create difficulties in synchronizing the transmission of the signals, it is advantageous to employ storage devices at the interface or buffer between the programmable processor or digital computer and the hardwired control of the elevator system.

The software of a programmable dispatcher must perform such basic functions as the reading and storing of car status data, for each elevator car in the system, reading and storing corridor call data, processing the stored system data to determine the most advantageous pattern of call allocation and service assignments to the elevator cars, sending commands to stationary cars to initiate the cars on a predetermined service assignment, sending stop requests to moving elevator cars to stop them at selected floors, and outputting signals indicative of system conditions for the proper functioning of other system components.

The program for performing these functions may require a substantial amount of running time, especially when the elevator system is experiencing peak loads. For example, if the running time of the program is such that the time between receiving the car status data and the outputting of a stop request to a moving car based on this data, is long enough for the moving car to have moved past the deceleration point for the floor at which the car was to stop, the stop request would be "stale" and the call for this floor would have to be reallocated on the next run through the program.

Therefore, it would be desirable to provide a new and improved elevator system which includes a programmable dispatcher, with the programmable dispatcher operating in such a manner that it efficiently performs all of its necessary functions while providing valid stop signals from moving cars.

SUMMARY OF THE INVENTION

Briefly, the present invention is a new and improved elevator system, and a new and improved method of controlling the movement of a plurality of elevator cars, which permits sequential processing of the signals, essential to a programmable digital computer dispatcher, while providing highly efficient elevator service, including valid output signals to moving cars. The new and improved elevator system includes a plurality of elevator cars controlled by a digital computer having a memory and a program stored therein for collecting data from the elevator system, making decisions based on the data, and outputting signals for allocating floor calls to suitably conditioned cars already busy serving floor and/or car calls, and for assigning in-service cars which are not busy serving a call for elevator service to calls which cannot be allocated to busy cars.

The program is divided into predetermined subsections, and first means, which is responsive to floor calls and other system data, indicates which of the subprograms have a need to run. Second means serially runs the subsections which have a need to run, with their running sequence being selected by the second means.

In a specific implementation of the invention, the program is divided into a plurality of subsections or subprograms, including an interrupt subsection, a priority subsection, a timer subsection, and a plurality of additional function subsections. The function subsections, which will hereinafter be referred to as subprograms, or simply as programs, are each assigned a different priority rating based upon the relative importance of the various functions from the standpoint of maintaining valid output signals to moving cars. The interrupt program places the timer program into bid at regular intervals. The timer program is assigned the highest priority and is bid by the interrupt program. The interrupt program runs immediately when a time interrupt generator initiates a time interrupt signal. The funtion programs are bid by other function programs. Additionally, in certain applications it may be desirable for one or more of the function programs to be placed in bid by the interrupt program, if these certain functions have not run for a predetermined period of time. When the interrupt executive program runs it runs immediately, with the program running at the time of the interrupt being suspended. When the interrupt program has been completed, it restarts the suspended program from the point at which it was suspended. When a function program places another function program into bid, the function program which is currently running continues to run until completion, and then control is transferred to the priority executive program, which then runs the function program having the highest priority of those bidding to run. If the time program has been placed into bid by the interrupt program, it will run before any other function program bidding to run, since it has the highest priority.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIG. 12 is a diagrammatic presentation of the input words received by the system processor from each elevator car of the system;

FIG. 13 is a diagrammatic representation of the output words prepared by the system processor for each elevator car of the system, and sent to the associated car controllers thereof;

FIG. 14 is a diagrammatic representation of an additional word established by the software system for each elevator car;

FIG. 15 is a diagrammatic representation of a zone code which may be used to identify corridor call location and service direction request, as well as the locations and movements of the various elevator cars in the associated building;

DESCRIPTION OF PREFERRED EMBODIMENTS

FIG. 1

Figure 1:
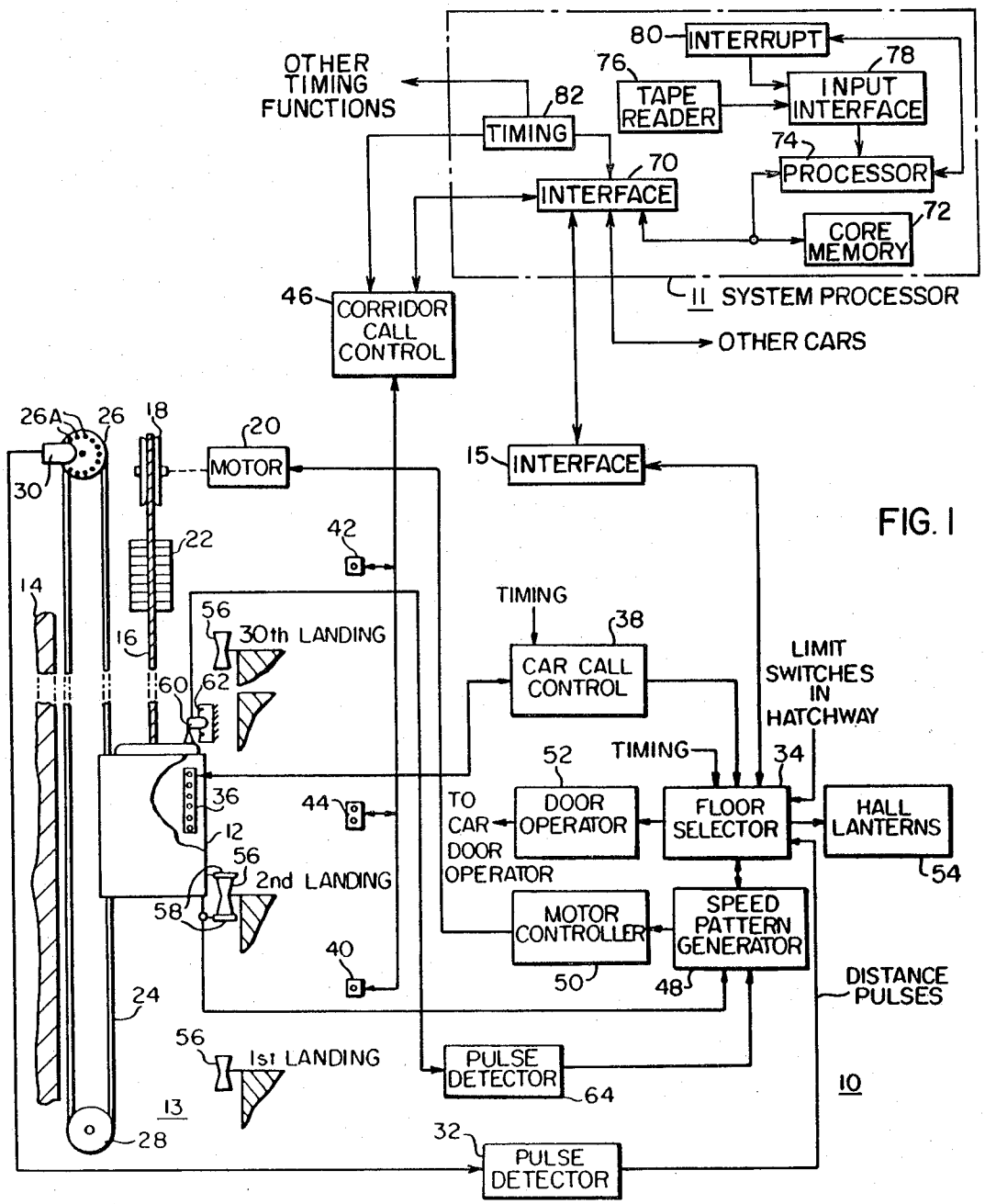
FIG. 1 is a partially schematic and partially block diagram of an elevator system which may utilize the teachings of the invention.

Referring now to the drawings, and FIG. 1 in particular, there is shown an elevator system 10 which may utilize the teachings of the invention. Elevator system 10 includes a plurality of cars, such as car 12, the movement of which is controlled by a system processor 11. Since each of the cars of the bank of cars, and the controls therefor, are similar in construction and operation, only the controls for car 12 will be described.

More specifically, car 12 is mounted in a hatchway 13 for movement relative to a structure 14 having a plurality of landings, such as 30, with only the first, second and thirtieth landings being shown in order to simplify the drawing. The car 12 is supported by a rope 16 which is reeved over a traction sheave 18 mounted on the shaft of a drive motor 20, such as a direct current motor as used in the Ward-Leonard drive system, or in a solid state drive system. A counterweight 22 is connected to the other end of the rope 16. A governor rope 24 which is connected to the top and bottom of the car is reeved over a governor sheave 26 located above the highest point of travel of the car in the hatchway 13, and over a pulley 28 located at the bottom of the hatchway. A pick-up 30 is disposed to detect movement of the car 12 through the effect of circumferentially spaced openings 26A in the governor sheave 26. The openings in the governor sheave are spaced to provide a pulse for each standard increment of travel of the car, such as a pulse for each 0.5 inch of car travel. Pick-up 30, which may be of any suitable type, such as optical or magnetic, provides pulses in response to the movement of the openings 26A in the governor sheave. Pick-up 30 is connected to a pulse detector 32 which provides distance pulses for a floor selector 34. Distance pulses may be developed in any other suitable manner, such as by a pick-up disposed on the car which cooperates with regularly spaced indicia in the hatchway.

Car calls, as registered by push button array 36 mounted in the car 12, are recorded and serialized in car call control 38, and the resulting serialized car call information is directed to the floor selector 34.

Corridor calls, as registered by push buttons mounted in the corridors, such as the up push button 40 located at the first landing, the down push button 42 located at the thirtieth landing, and the up and down push buttons 44 located at the second and other intermediate landings, are recorded and serialized in corridor call control 46. The resulting serialized corridor call information is directed to the system processor 11. The system processor 11 directs the corridor calls to the cars through an interface circuit, shown generally at 15, to effect efficient service for the various floors of the building and effective use of the cars.

The floor selector 34 processes the distance pulses from pulse detector 32 to develop information concerning the position of the car 12 in the hatchway 13, and also directs these processed distance pulses to a speed pattern generator 48 which generates a speed reference signal for a motor controller 50, which in turn provides the drive voltage for motor 20.

The floor selector 34 keeps track of the car 12 and the calls for service for the car, it provides the request to accelerate signal to the speed pattern generator 48, and provides the deceleration signal for the speed pattern generator 48 at the precise time required for the car to decelerate according to a predetermined deceleration pattern and stop at a predetermined floor for which a call for service has been registered. The floor selector 34 also provides signals for controlling such auxiliary devices as the door operator 52, the hall lanterns 54, and it controls the resetting of the car call and corridor call controls when a car or corridor call has been serviced.

Landing, and leveling of the car at the landing, is accomplished by a hatch transducer system which utilizes inductor plates 56 disposed at each landing, and a transformer 58 disposed on the car 12.

The motor controller 50 includes a speed regulator responsive to the reference pattern provided by the speed pattern generator 48. The speed control may be derived from a comparison of the actual speed of the motor and that called for by the reference pattern by using a drag magnet regulator, such as disclosed in U.S. Pat. Nos. 2,874,806 and 3,207,265, which are assigned to the same assignee as the present application. The precision landing system using inductor plates and transformer 58 is described in detail in U.S. Pat. No. 3,207,265.

An overspeed condition near either the upper or lower terminal is detected by the combination of a pick-up 60 and slow-down blades, such as a slow-down blade 62. The pick-up 60 is preferably mounted on the car 12, and a slow-down blade is mounted near each terminal. The slow-down blade has spaced openings, such as a toothed edge, with the teeth being spaced to generate pulses in a pick-up 60 when there is relative motion between them. These pulses are processed in pulse detector 64 and directed to the speed pattern generator 48 where they are used to detect overspeeds.

A new and improved floor selector 32 for operating a single elevator car, without regard to operation of the car in a bank of cars, has been disclosed in co-pending application Ser. No. 254,007, filed May 17, 1972, now U.S. Pat. No. 3,750,850 which is assigned to the same assignee as the present application. In order to avoid duplication and to limit the complexity of the present application, application Ser. No. 254,007, filed May 17, 1972, is hereby incorporated by reference, and will hereinafter be referred to as the first incorporated application.

The programmable system processor 11 includes an interface function 70 for receiving signals from, and sending signals to, the car controllers (interface 15) of the elevator cars in the elevator system, a core memory 72 in which a software package is stored, a procesor 74 for executing instructions stored in the memory 72 relative to the dispatching of elevator cars and otherwise controlling a group of elevator cars according to software strategy stored in the core memory, a tape reader 76, an input interface 78 for transferring the software data from paper tape, or the like, to the core memory 72, an interrupt function 80, also connected to the processor 74 via input interface 78, and a timing function 82 for controlling the transmission of data between the system processor 11 and the car controllers of the elevator cars.

Concurrently filed application Ser. No. 340,618, filed Mar. 12, 1973, now U.S. Pat. No. 3,804,209 in the name of David Edison entitled "Elevator System", which is assigned to the same assignee as the present application, discloses a new and improved elevator system for operating a plurality of elevator cars in response to signals provided by a programmable system processor. This application is hereby incorporated by reference, and will be hereinafter referred to as the second incorporated application. The second incorporated application sets forth the changes necessary in each single car control, described in the first incorporated application, as well as details of the interface functions 15 and 17, and master timing 82, shown in block form in FIG. 1, for operating a plurality of elevator cars according to a software program stored in the core memory 72. The present application, as well as the concurrently filed applications referred to under the heading "Cross-References to Related Applications", collectively set forth a new and improved processor 74 for executing the instructions stored in the core memory 72, as well as new and improved strategy for dispatching a plurality of elevator cars to more efficiently service calls for elevator service registered from the various landings or floors of an associated structure. The new and improved strategy is implemented by software, which acts upon the data received from the corridor call registers and from the car controllers of the various elevator cars, to provide signals for the car controllers which effect the new and improved strategy of the stored program.

FIG. 2

Figure 2:
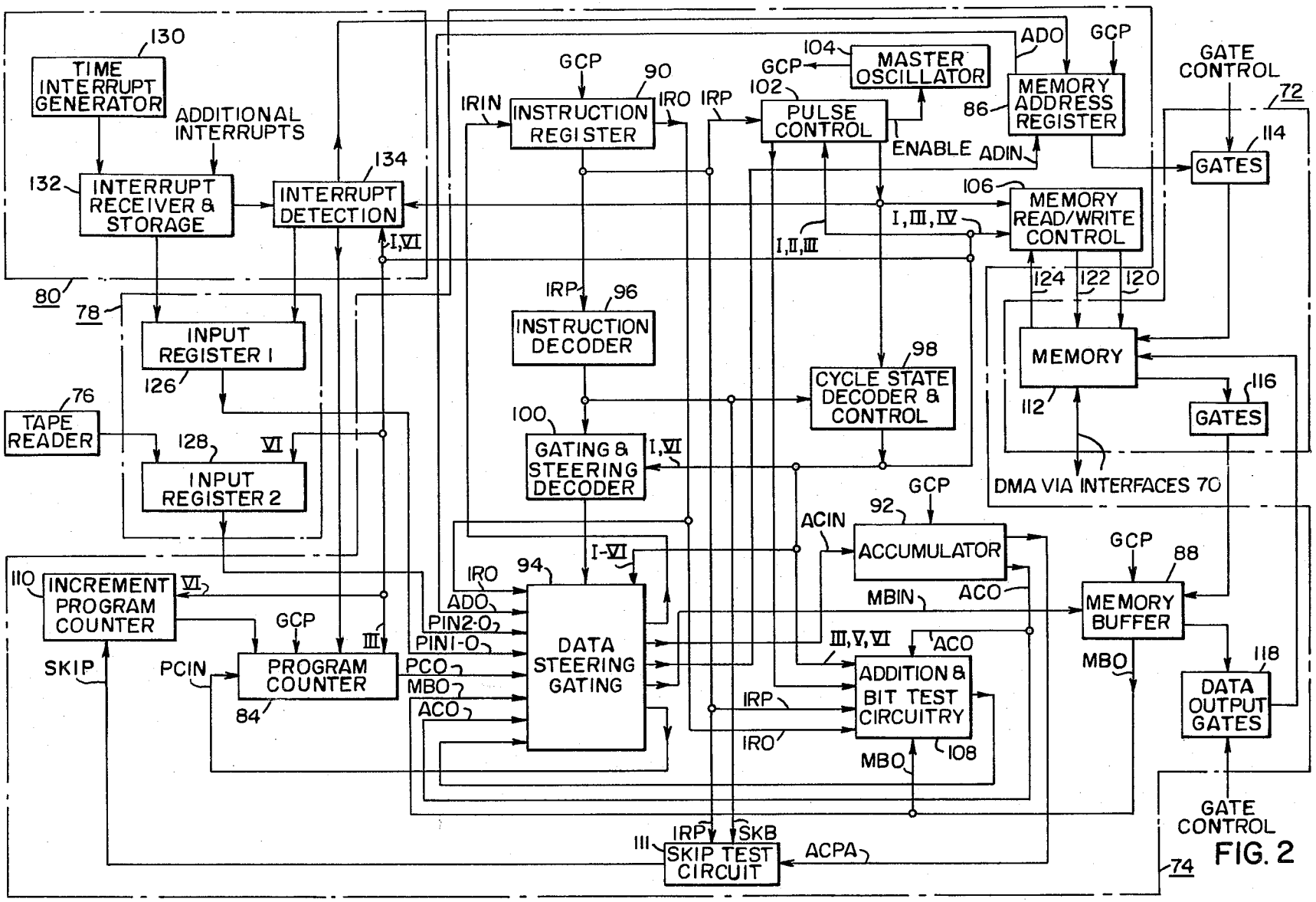
FIG. 2 is a detailed block diagram of a system processor which may be used in the elevator system shown in FIG. 1.

FIG. 2 is a detailed block digram of the processor 74 shown in FIG. 1, as well as the core memory 72, the input interface 70, the tape reader 76, and the interrupt function 80. Since the programmable system processor 11 is broadly similar in function to most digital computers, and is therefore well known to those skilled in the art, a block diagram of the various functions will be sufficient description for those skilled in the digital computer art.

Processor 74 is a special purpose controller which utilizes a stored program, a fixed instruction set, and a fixed cycle control sequence, to control serial gating of data between the various registers of the programmable system processor 11. For purposes of example, the instruction and data word lengths are 12 bits wide, permitting the addressing of 4,096 words of memory, but an 8K core, or larger, may be used, as required by a specific application.

Processor 74 includes five registers, a program counter register 84, a memory address register 86, a memory buffer register 88, an instruction register 90, and an accumulator register 92.

The program counter 84 provides a pointer to memory 72 for instruction execution. The contents of the program counter 84 provide the address of the instruction being executed.

The memory address register 86 is a temporary storage register for forming addresses for memory read and write functions.

The memory buffer register 88 is the interface for data transferred to and from the memory 72.

The instruction register 90 is the temporary storage location for the instruction being executed.

The accumulator register 92 is a temporary storage location for the result of arithmetic and logical operations.

The processor 74 also includes a data steering gating function 94 which steers input data to the proper register according to the instruction being executed and the specific cycle state of the processor. An instruction decoder 96 and cycle state decoder and control 98 control the gating paths established in a gating and steering function 100, which in turn specifies the gating paths in the data steering gating 94. Clocking of data is controlled by a pulse control function 102, which is responsive to the instruction register 90 and cycle state decoder and control 98, to provide an enable signal for a master oscillator or clock 104. The master oscillator 104 provides the correct number of gating pulses GCP for the specific function being executed.

The pulse control 102 and cycle state decoder and control 98 also control a memory read and write function 106, which in turn sets the memory for a reading or writing function, depending upon the specific cycle state dictated by the instruction.

The various arithmetic and logical functions which cooperate with the accumulator register 92 are shown generally at 108, and the function of incrementing the program counter register is shown at 110.

A skip test circuit 111 provides a signal SKIP for the circuitry 110 for incrementing the program counter 84, when the program counter 84 is to be incremented by two instead of by one.

The instruction set for the systems processor 11 includes eight memory reference instructions, i.e., those which require a memory operation in the execution of the instruction other than the initial memory operation required to call up the function, and sixteen accumulator reference instructions, i.e., those that cause operation of the current contents of the accumulator at the beginning of the instruction execution.

The instruction set is as follows:

| Memory Reference Instructions | Mnemonic | Code |
|---|---|---|
| 1. Load Accumulator | LDA | 111( ) XXXX XXXX |
| 2. Add Accumulator | ADD | 110( ) XXXX XXXX |
| 3. And Accumulator | AND | 001( ) XXXX XXXX |
| 4. Exclusive Or Accumulator | XOR | 010( ) XXXX XXXX |
| 5. Store Accumulator | STA | 101( ) XXXX XXXX |
| 6. Store Program Counter | STP | 100( ) XXXX XXXX |
| 7. Program Branch | BRA | 011( ) XXXX XXXX |
| 8. Operate | OPR | 000 1 XXXX XXXX |

| Accumulator Reference Instructions | Mnemonic | Code |
|---|---|---|
| 1. Skip Unconditionally | SKU | 0000 0000 YYYY |
| 2. Form 2's Complement | CHS | 0000 0001 YYYY |
| 3. Load Accumulator With Zero | LDZ | 0000 0010 YYYY |
| 4. Priority Interrupt | PRI | 0000 0011 0000 |
| 5. Long Shift | LSA | 0000 0100 YYYY |
| 6. Short Shift | SSA | 0000 0101 YYYY |
| 7. Skip On Bit | SKB | 0000 0110 YYYY |
| 8. Set A Bit | SET | 0000 0111 YYYY |
| 9. Input | INP | 0000 1000 00YY |
| 10. Output | OUT | 0000 1001 00YY |
| 11. Skip on Zero | SKZ | 0000 1010 0000 |
| 12. Skip on Positive | SKP | 0000 1011 0000 |
| 13. Skip on Negative | SKN | 0000 1100 0000 |
| 14. One's Complement | NOT | 0000 1101 0000 |
| 15. Literal Add | LTA | 0000 1110 YYYY |
| 16. Set Bit To Zero | STZ | 0000 1111 YYYY |

The addressing of the memory reference instructions may be "direct", in which event the instruction is stored on the same page of the core memory 72 as the address of the instruction provided by the program counter 84. The addressing of the memory reference instructions may also be "indirect", in which event the instruction is stored in a different page of the memory than the page on which the address of the instruction provided by the program counter 84 is stored. The fourth MSB of the instruction code determines whether the addressing will be direct or indirect, with a logical "one" indicating a direct instruction and a logical "zero" indicating an indirect instruction. With a direct instruction, the address of the memory to be operated is determined by the four MSB of the program counter and the eight LSB of the instruction. The four MSB of the program counter defines one of the sixteen possible 256 word pages within the 4,096 word blocks of core memory, and the eight LSB of the instruction defines the word within the page.

With indirect addressing, the four MSB of the program counter 84 and the eight LSB of the instruction are used for determining an address in the same page as the program counter pointer, and the contents of this address is the address of the memory to be operated upon. Since this address is a full 12 bit word, this address can be anywhere within the 4,096 word block of memory 72.

Figure 3:
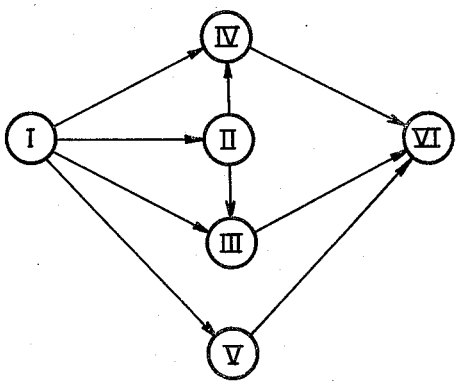
FIG. 3 is a schematic representation of instruction cycle state sequences which may be used to execute instructions by the system processor shown in FIG. 2.

A fixed cycle control sequence is utliized to effect instruction execution. The control sequence includes six possible cycle states. However, every cycle state is not utilized for every instruction. FIG. 3 illustrates the five different cycle state sequences that are used, with the Roman numerals indicating cycle states as follows:

I—Instruction Fetch
II—Indirect Addressing
III—Memory Read
IV—Memory Write
V—Accumulator Reference
VI—Increment Program Counter Cycle states I and VI are used with all instructions, while the use of the remaining cycle states depend upon the specific instruction being executed. For example, a memory reference instruction involving a memory read operation would use cycle states I, III and VI with direct addressing, and cycle states I, II, III and VI with indirect addressing. A memory reference instruction involving a memory write operation would use cycle states I, IV and VI with direct addressing, and cycle states I, II, IV and VI with indirect addressing. An accumulator reference instruction would use cycle states I, V and VI.

Cycle state I calls up from the memory the instruction to be executed. At the start of cycle state I, the address of the instruction is in the program counter 84. The contents of the program counter 84, indicated by serial output signal PCO is transferred to the serial input ADIN of the memory address register 86 via the data steering gating circuits 94. The cycle state decoder and control 98 is outputting the cycle state signal for cycle state I to both the gating and steering decoder 100, which sets the gating paths in data steering gating 94, and to memory read/write control 106, which sets the memory 72 for the memory read operation required to call up the address of the instruction placed in the memory address register 86. The memory address from the memory address register 86 is transferred in parallel to the core memory 112 via gates 114, and the contents of this address is transferred in parallel to the memory buffer register 88 via gates 116. The contents of the memory buffer register 88 are then transferred serially indicated by output signal MBO, by the gating pulses GCP to the input IRIN of the instruction register 90 via data steering gating circuit 94.

Various parts of the instruction in the instruction register 90 are transferred in parallel to the instruction decoder 96, pulse control 102, and addition and bit test circuitry 108. The instruction decoder 96 sets gates in the gating and steering decoder 100, and it enables the cycle state decoder and control 98 to provide the cycle state output signal associated with the specific instruction.

If the instruction placed in the instruction register 90 was an indirect memory reference instruction, the sequence automatically advances to cycle state II. Cycle state II obtains the memory address that data is to be read from during cycle state III, or written into during cycle state IV, depending upon the specific instruction. In cycle state II, the four MSB of the program counter 84 contained in the serial output signal PCO, and the eight LSB of the instruction register 90 contained in the serial output signal IRO are transferred to the memory address register 86 via the data steering gating circuits 94, which have been preset to accomplish this function.

If the instruction being executed is a direct memory reference instruction which requires a memory read operation (instructions LDA, ADD, AND, XOR, BRA and OPR direct) advancement is made directly from cycle state I to cycle state III. If the instruction being executed is an indirect memory reference instruction of this type, advancement is made from cycle state II to cycle state III.

Cycle state III obtains the data from memory 112 that is to be operated upon by the instruction execution. The memory address for this data is contained in the memory buffer register 88 for an indirect instruction, as a result of the memory read operation in cycle state II, and is contained in the four MSB of the program counter 84 and eight LSB of the instruction register 90 for a direct instruction. During cycle state III, this data is transferred from its location to the address register 86 via the data steering gating circuit 94, and a memory read operation is initiated in response to signal III being applied to memory read/write control 106 from the cycle state decoder and control 98. The data read from the memory 112 is transferred in parallel to the memory buffer register 88, and is then serially transferred to the accumulator register 92 via data steering gating circuits 94, or operated upon by the contents of the accumulator 92 and the result stored in the accumulator 92, or transferred to the program counter 84, depending upon the specific instruction.

If the instruction being executed is a direct memory reference instruction which requires a memory write operation (instructions STP and STA) advancement is made directly from cycle state I to cycle state IV. If the instruction being executed is an indirect memory reference instruction of this type, advancement is made from cycle state II to cycle state IV. Cycle state IV writes data into memory 112. The memory address for the write operation is contained in the memory buffer register 88 for an indirect instruction, and is contained in the four MSB of the program counter 84 and the eight LSB of the instruction register 90 for a direct instruction. During cycle state IV, this data is transferred from its location to the memory address register 86 via the data steering gating circuits 94. The data to be written into the memory 112 is contained in either the accumulator 92 or the program counter 84, and during cycle state IV, this data is transferred serially from its location to the memory buffer register 88 via the data steering gating circuits 94. Signal IV from cycle state decoder and control 98 enables the memory read/write control 106 to prepare the memory 112 for the write operation, and the data transferred to the memory buffer register 88 is transferred in parallel to memory 112 via gates 118 to the memory address contained in the memory address register 86.

If the instruction read during cycle state I was an accumulator reference instruction, advancement is made directly from cycle state I to cycle state V. Cycle state V is used to operate upon the contents of the accumulator 92.

At the completion of cycle states III, IV and V, advancement is made to cycle state VI, which increments the program counter 84. Cycle state decoder and control 98 outputs the signal VI to increment the program counter function 110, which advances the program counter to establish the memory address of the next instruction to be executed. Since memory operations are not required during cycle state VI, control of the memory 112 is relinquished to direct memory access (DMA), enabling data words to be exchanged between the memory 112 and the car controllers of the elevator cars.

The execution of the LDA instruction results in the accumulator 92 being loaded with the contents of a memory location. With an LDA direct instruction, the contents of the memory location defined by the four MSB of the program counter 84 and the eight LSB of the instruction contained in the instruction register 90 is loaded into the accumulator 92. For example, if the program counter 84 contains the hexadecimal count $CO1_{16}$, and the memory address $CO1_{16}$ contains $FD7_{16}$, the address of the data is the hexadecimal number $CD7_{16}$. If the data at this address is assumed to be $513_{16}$, the execution of this instruction would result in the hexadecimal number $513_{16}$ being in the accumulator 92.

If the LDA instruction was indirect, instead of direct, the contents of the memory location defined by the four MSB of the program counter 84 and the eight LSB of the instruction would be used as an address instead of data. The contents of this address would then be loaded into the accumulator 92. For example, if the contents of the program counter 84 is $CO1_{16}$, and the contents of memory address $CO1_{16}$ is $ED7_{16}$, memory location $CD7_{16}$ would be read to obtain the address $513_{16}$, and memory location $513_{16}$ would be read to obtain the data, which for example will be assumed to be $714_{16}$. The execution of this instruction thus results in the hexadecimal number $714_{16}$ residing in the accumulator 92. Execution of either the LDA direct or indirect instruction results in erasure of the previous contents of the accumulator.

Execution of the ADD instruction results in the contents of the accumulator 92 being added with the contents of a memory location, with the sum being stored in the accumulator 92. The previous contents of the accumulator are destroyed.

Execution of the AND instruction results in the contents of the accumulator and the contents of a memory location being AND'ed on a bit-by-bit basis. The result is stored in the accumulator, which erases or destroys the previous contents thereof.

Execution of the XOR instruction results in the contents of the accumulator and the contents of a memory location being exclusive OR'ed on a bit-by-bit basis. The result is stored in the accumulator, which destroys its previous contents.

Execution of the STA instruction results in the contents of the accumulator being stored in a memory location. The execution of this instruction does not change the contents of the accumulator.

Execution of the STP instruction results in the current contents of the program counter 84 being stored in a memory location. The contents of the program counter are not changed by the instruction execution, with the exception that the program counter is incremented by one at the end of the instruction execution.

The instruction BRA is used to cause branching, i.e., program execution is switched to memory locations which are not in the normal sequence of adjacent memory locations. The BRA instruction loads the program counter 84. The program counter 84 is incremented by 2 at the completion of the BRA instruction.

The OPR direct instruction permits indirect loading of the accumulator 92 with data stored in the direct memory access (DMA) portion of the memory 112. The DMA portion of memory 112 is that portion into which data is written or read by the car controllers of the various elevator cars without program intervention.

The accumulator reference instructions are a sub-set of the OPR direct instruction. The most significant digit $O_{16}$ defines the OPR indirect accumulator reference class of instructions. The middle hexadecimal digit defines the specific accumulator reference instruction. The least significant hexadecimal digit defines the literal of the instruction.

The SKU instruction is used to skip the execution of a number of sequential instructions, with the number of instructions skipped being set forth in the literal. The accumulator contents are not changed and the program counter is not further incremented beyond the necessary to skip the desired number of instructions.

Execution of the CHS instruction results in the 2's complement of the data in the accumulator being formed and stored in the accumulator.

Execution of the LDZ instruction results in the accumulator contents being replaced by $000_{16}$.

Execution of instruction PRI is used for priority interrupts.

Execution of instruction LSA results in the contents of the accumulator being shifted right. The amount of right shift is determined by the literal. The shift is performed by recirculation.

Execution of instruction SSA is similar to the LSA instruction, with the exception that recirculation is not performed. The accumulator is filled with zeros from the left as the shift is performed.

Execution of instruction SKB results in skipping the next instruction if the tested bit is equal to logical one. In other words, the program counter is incremented by two if the tested bit is logical one, and is incremented by one if the tested bit is a logical zero. The bit to be tested is determined by decoding the literal. The accumulator contents are not altered by execution of this instruction.

Execution of instruction SET results in a selected bit of the accumulator being set for a logical one. The bit to be set is determined by decoding the literal. Bits other than the specified bit of the accumulator are not changed by execution of this instruction.

Execution of instruction INP causes the contents of one of the input registers 126 or 128 shown in FIG. 2 to be transferred to the accumulator. The two LSB of the literal selects the input register, with a 01 referring to input register 126 and a 10 referring to input register 128. The contents of the addressed input register remain unchanged by execution of this instruction.

Execution of instruction OUT forces the contents of the accumulator to transfer to an output register. Since an output register is not presently used, this instruction would not be used until such a register is required.

Execution of instruction SKZ results in the next instruction in the sequence being skipped if the contents of the accumulator is zero. In other words, the program counter 84 is incremented by two if all of the bits of the accumulator are logical zeros. The program counter is incremented by one if any bit of the accumulator is a logical one. The contents of the accumulator are not altered by execution of this instruction.

Execution of instruction SKP results in the next instruction in sequence being skipped if the contents of the accumulator is positive. This condition is satisfied if the most significant bit of the accumulator is logical zero and the contents of the accumulator is not $000_{16}$.

Execution of this instruction does not alter the contents of the accumulator.

Execution of instruction SKN results in the next instruction in sequence being skipped if the contents of the accumulator is negative. This condition is satisfied if the most significant bit of the accumulator is a logical one. The contents of the accumulator are not changed by execution of this instruction.

Execution of instruction NOT results in the one's complement of the accumulator contents being formed. The result is stored in the accumulator and the previous contents thereof are destroyed.

Execution of instruction LTA results in the literal being arithmeticly added to the contents of the accumulator. The results are stored in the accumulator and the previous contents are destroyed.

Execution of instruction STZ results in a bit of the accumulator being set to logical zero. The bit to be set to zero is defined by decoding the literal. For example, if the literal is 0000, it refers to the LSB, and if the literal is 1011 is refers to the MSB of the accumulator. Only the bit specified by decoding the literal is affected by execution of this instruction.

The master oscillator 104 may include a crystal controlled oscillator which provides gated clock pulses GCP at the desired rate, such as 6 MHZ, for shifting and control of data transferred within the processor 74. The gating signal for initiating the pulses GCP is the signal ENABLE provided by the pulse control circuit 102.

The pulse control circuit 102 may include a 4 bit binary synchronous counter which is parallel loaded to provide a predetermined number of active clock pulses, up to and including 12, in response to the four LSB of the instruction register 90. The pulse control 102, in addition to controlling the number of active clock pulses, provides clock pulses on count 0 and on count 15 of the synchronous counter which establishes the gating paths necessary to enable gated clock pulse generation. Set and reset pulses are also provided on counts 0 and 14, respectively of the synchronous counter. The 12 gated clock pulses appear on counts 3 through 14 of this counter.

For example, assume the synchronous counter is on count 15, which halted the count from a previous cycle state. When a signal is provided to transfer or shift the data, the counter will advance to a count of 0, which count establishes the gating necessary to enable clock pulse generation, and it also establishes the parallel loading of the counter. Gated clock pulses are generated from the beginning of the next clock pulse. Upon the next clock pulse the counter is parallel loaded to an initial value necessary to permit the correct number of gated clock pulses to be generated. The gated clock pulse circuitry is disabled on count 14 and the cycle state advanced. The count of 15 halts the counting operation, completing the data shift or transfer for a given cycle state, or a portion of a cycle state, when a cycle state requires more than one data shift.

The cycle state decoder and control 98 may include a binary synchronous counter which is either parallel loaded or advanced by one count depending upon the specific instruction, which forces the parallel load circuitry to follow the requisite instruction cycle state sequence, as shown in FIG. 3. The outputs of the counter are decoded to provide signals I through VI, corresponding to the specific cycle state the processor is in at any instant.

The read/write memory control 106 is gated at the proper time by count 14 from the pulse control 102 and the various cycle state signals which require a memory operation. A read or write signal is provided by control 106, over lines 120 or 122, respectively, when the memory 112 is not busy, as indicated by the absence of a memory busy signal over line 124.

The instruction decoder 96 may include, for example, a 3 to 8 line decoder responsive to parallel output bits 9 through 11 of parallel output signal IRP of instruction register 90, for decoding the 8 memory reference instructions, and a 4 to 16 line decoder responsive to bits 4 through 7 of parallel output IRP of instruction register 90, for decoding the 16 accumulator reference instructions. The instruction decoding circuitry 96 and the cycle state output signals from cycle state decoder and control 98 provide the inputs to the gating and steering decoder logic 100. The outputs of logic 100 establish the gating paths for the gated clock pulses GCP.

The data steering gating 94 receives inputs from the various registers, and steers these signals to the input of the proper register as established by the specific instruction and cycle state of the instruction execution sequence.

Program counter register 84, memory address register 86, memory buffer register 88, instruction register 90, and accumulator register 92, may each include three, four bit synchronous shift registers. The clock pulse input to the registers may be the GCP signal which is gated under control of the gating and steering decoder logic 100.

The increment program counter circuitry 110, for example, may include a full adder, a first flip-flop for saving the carry for each serial arithmetic operation, and a second flip-flop utilized to add an additional 1 to the program counter contents. The program counter 84 is incremented by 1 or 2 during cycle state VI for all instructions except SKU. The program counter is incremented by 1 during cycle state VI, except when the second flip-flop is set by a signal SKIP which causes the program counter to be incremented by 2.

The signal SKIP is provided by the skip test circuit 111. A 16 to 1 line multiplexer may be utilized to test the bit selected by the SKB instruction. The parallel outputs ACPA of the accumulator 92 are connected to the data inputs of the multiplexer, and the four LSB of the instruction register 90 are connected to the data select inputs. The multiplexer is enabled by the SKB instruction. Thus, when the SKB instruction is executed, the accumulator bit defined by the code of the four LSB of the program counter will determine the state of the SKIP signal.

The addition and bit test circuitry 108 includes the full adders and flip-flops required to save their carry outputs resulting from bit serial addition. One addition circuit is used for execution of the SKU instruction during cycle state VI, in which the contents of the four LSB of the instruction register 90 are added to the contents of the program counter 84. Another addition circuit is operative during cycle state V for adding the contents of the four LSB of the instruction register 90 to the contents of the accumulator 92 for execution of instruction LTA. Still another addition circuit is operative during cycle state III, for implementing the ADD, AND and XOR instructions.

The addition and bit test circuitry 108 also includes the set/clear bit circuitry used with the SET and STZ instructions, which force a selected bit of the accumulator 92 to a logical one and logical zero, respectively. The bit manipulation is accomplished on a serial basis as the accumulator 92 is shifted during cycle state V. For example, the data outputs of a 4 to 16 line decoder may be cross connected to the data inputs of a 16 to 1 line multiplexer. The inputs of the decoder are connected to the four LSB of the instruction register 90. The output of the multiplexer provides a signal which may be utilized to control the setting or clearing of the appropriate bit. The outputs of the pulse control counter of pulse control 102 are connected to the data select inputs of the multiplexer. The output of the multiplexer is a logical one during the interval the selected bit is being shifted, which may be used to force the serial input to the accumulator 92 during this interval to a logical one or a logical zero in response to a SET or STZ instruction, respectively.

The addition and bit test circuitry 108 also includes circuitry for performing the 2's complement function.

The input interface 78 includes two 12 bit registers 126 and 128 referred to as input register No. 1 and input register No. 2, respectively. Input register No. 1 provides interrupt inputs to the processor 74, and input register No. 2 provides data input to the processor 74 via external devices, such as the tape reader 76.

The interrupt circuitry 80 which provides interrupts for input register No. 1 includes a time interrupt generator 130, interrupt receiver and storage circuitry 132, and interrupt detection circuitry 134.

The interrupt receiver and storage circuitry 132 has inputs connected to the time interrupt generator 130, as well as to any additional interrupts, such as an interrupt responsive to a low voltage detector. Pulses are generated by the interrupts in circuit 132 which are directed to the interrupt detection circuitry 134, and also stored in memories, such as flip-flops, which in turn are connected to the parallel inputs of input register No. 1. Input register No. 1 is loaded with a stored interrupt from circuit 132 in response to a signal from the interrupt detection circuit 134, which forces parallel loading of input register No. 1. This signal remains active until the contents of input register No. 1 are serially transferred to the accumulator 92 via data steering gating 94. The processor 74 inputs the contents of input register No. 1 to the accumulator 92 in order to read the active interrupt number. The interrupt storage flip-flops are reset when input register No. 1 is loaded.

The interrupt detection circuitry 134, upon receiving an interrupt signal from circuitry 132, provides a signal to the processor 74 of an active interrupt, including signals to program counter 84 and memory address register 86. The signals from the interrupt detection circuitry 134 to the memory address register 86 zero's the memory address register to force the instruction STP located at $000_{16}$ to store the contents of the program counter. The signal from the interrupt detection circuitry 134 to the program counter 84 forces the contents of the program counter to be zeroed during cycle state III, to force the instruction STA located at $001_{16}$. The STA instruction stores the contents of the accumulator. A program associated with an interrupt may then be initiated.

FIG. 4

Figure 4:
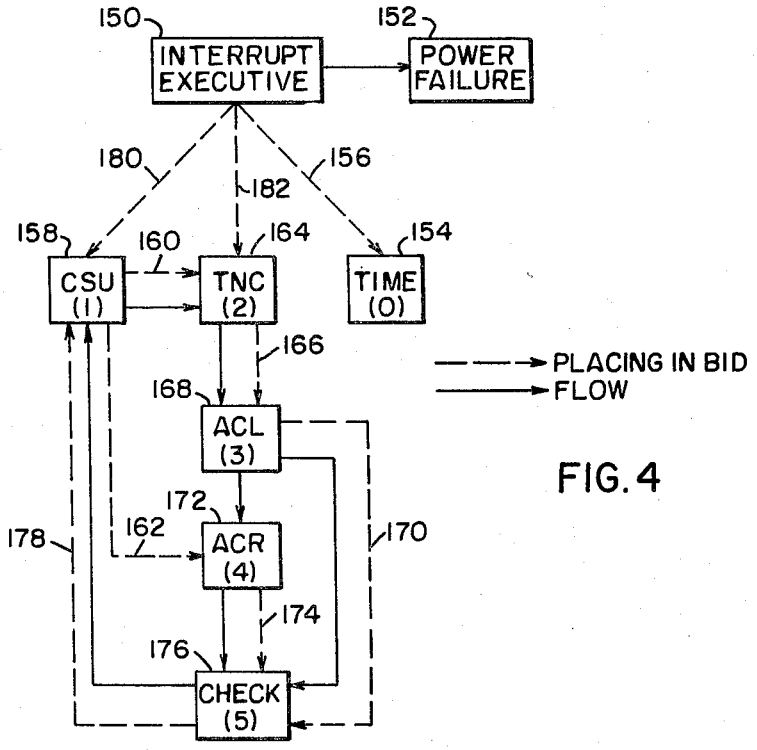
FIG. 4 is a block diagram of a new and improved software system for the elevator system shown in FIG. 1, which directs the system processor hardware to the task of operating the elevator system to provide improved elevator service.

FIG. 4 is a block diagram which illustrates a new and improved arrangement of subprograms for effecting the dispatching and control of a plurality of elevator cars. In general, the concept is divide the program into subsections, and include means, hardware, software, or both, for indicating which subsections of the program have a need to run, as determined by signals and data provided by the elevator system. Additional means then serially runs the sub-sections of the program which have a need to run with their sequence being based on their relative urgencies. The software of a programmable system processor for directing the associated hardware to the task of elevator car dispatching must (a) read and store car status data from the car controller of the various elevator cars, (b) read and store corridor call data, (c) process the system data obtained in (a) and (b) to determine an advantageous pattern of service assignments to the cars, (d) send commands to initiate an elevator car on a determined service assignment, (e) send floor numbers to running cars to indicate appropriate stopping points, and (f) output signals indicative of system conditions, as necessary to the proper functioning of other system components.

The software scheme employed should permit strategy changes to be incorporated without modification of the overall program concept. Further, the software should accomplish all of the functions (a) through (e) listed above while using the sequential processing mode required with a digital computer system processor, in such a manner that stop requests to moving cars are almost always valid when received by the car controller of the associated car.

Certain physical features of the elevator installation affect the software, such as the total number of floors to be served by the elevator cars, the number of elevator cars in the bank or elevator system, the presence or absence of an express zone at which none of the cars stop, and basement and top extension floors to be served.

Certain strategy concepts which affect the software, regardless of the specific strategy to be implemented, are the main floor, or point where passengers initially enter the elevator system, zoning of the building for service assignment purposes, demands for service for a zone initiated by a corridor call from that zone when no car is presently assigned to the zone, and modifications of car assignment patterns according to traffic conditions.

The activities of the programmable system processor can be divided into two broad categories, (1) bookkeeping, and (2) actions initiated by significant events in the system. The bookkeeping activities must be performed on a cyclic basis, with a sufficiently high frequency to keep the computer's records up to date. This includes reading in the car status data and corridor call registers, and updating system-signal outputs. At any instant of time, the occurrence of an event in the system requires some special action by the computer, which temporarily must break the cyclic bookkeeping activity. Such significant events are (a) a new corridor call in the system, for which the computer or system processor must try to allocate to a suitable running car, or register a demand signal relative to the call which signifies that an available non-busy car, if any, must be assigned to the call, (b) car stops, which cancels a corridor call at that floor if the car and call service direction are similar, and perhaps may require a new stop request to the car, (c) a car becomes available, requiring the car to be assigned to a call for which a demand signal was created, if any, (d) a car leaves the main floor, which may require a replacement car to be brought to the main floor, (e) a car enters a new zone, which now allows calls in the new zone to be allocated to the car, possibly cancelling a demand, (f) a car is taken out of service, requiring any calls allocated to the car to be reallocated, if possible, or to create a demand signal for those which are not so allocated, and (g) a car is by-passing corridor calls, which may mean certain calls allocated to the car must be reallocated, or a demand signal created therefor. For purposes of this specification, calls added to the assignment register of a busy or running car, i.e., a car already busy on the task of serving a car call or a corridor call on a zone basis, as opposed to a specifically assigned basis, will be referred to as allocated calls, and corridor calls which cannot be so allocated and for which a demand signal is created, to which an available non-busy car is assigned, will be referred to as assigned or demand calls. In other words, calls are allocated, cars are assigned. In certain instances a call will be referred to as being unassigned, with this being for the convenience of the software language. What is meant, is that the call is considered unallocated.

The occurrence of an event in the system which requires action by the system processor may be detected by hardware, in which case the hardware generates an interrupt pulse which causes the normal cyclic activity of the computer to be broken; or, the events may be detected by software. Detection of an event by software is achieved by comparison of successive data records, in which case the program itself interrupts its cyclic bookkeeping function by branching itself into the action appropriate to the event detected.

A number of events will often occur in a very short period of time, and since they must be processed sequentially, the software arrangement assigns priority ratings to events in accordance with the urgency of the actions, and then the program processes them in the order of priority.

In the embodiment of the invention selected for illustration, two hardware interrupts are provided, one for power failure, and one for timing. The power failure interrupt enables the computer to initiate an emergency procedure when the line voltage falls below a predetermined level. The timing interrupt occurs at regular intervals, and is used by the computer to maintain a clock, so that timing of actions can be efficiently performed as required by the strategy. All other events are detected by comparison of successive data records, but other events may be detected by hardware, if desired.

The software package employed includes a set of function programs, i.e., bookkeeping and control programs, which run under the direction of an executive program. The executive program includes (a) an interrupt executive, shown generally at 150 in FIG. 4, which handles hardware interrupt processing, such as power failure indicated by block 152, and (b) a priority executive which controls the running of the function programs according to their priorities.

A unique priority is assigned to each function program as a fixed characteristic of the software package. There are four possible program states, (1) running, (2) suspended due to interrupt, (3) bidding to run, and (4) inactive.

The only program not subject to interrupt is the interrupt executive 150. Thus, the interrupt executive can only be in states (1) running, or (4) inactive. It is never bidding to run, since it runs immediately upon receipt of an interrupt pulse. If the interrupt is for timing, the interrupt executive decrements a clock, and may place a timer program into bid, and optionally may place certain other function programs into the bidding state before returning control to the suspended program. The optional feature is only required where the elevator system is such that certain bookkeeping programs may be prevented from running often enough to keep the system up to date during heavy traffic conditions, in which event the interrupt executive places them in bid when they haven't run for a predetermined selected period of time.

Once a function program starts, it runs either until completion, or until an interrupt occurs. In the former case, the program transfers back to the priority executive, while in the latter case control transfers to the interrupt executive and the function program goes into suspension. When the interrupt executive has completed, it restarts the suspended program from the point at which it was interrupted. Function programs, once started, are not suspended for the running of other function programs, regardless of priority ratings.

The function of the priority executive is to initiate the highest priority function program bidding to run. It is subject to interrupt in the same manner as the function programs. Function programs are placed in bid by other function programs, and by the interrupt executive. The interrupt executive places a timer program 154 into bid at predetermined intervals, such as every 3.2 seconds, as indicated by dashed line 156. The timer program 154 is given the highest priority, i.e., zero, to insure that it will run before any other function program when the priority program is checking the bid register to see which program to run next.

Before discussing the bidding structure further, it is essential to describe how the software package is divided into a plurality of subprograms, and the bidding priority associated with each. These subprograms are referred to as CSU, TNC, ACL, ACR, and CHECK.

Subprogram CSU, indicated by block 158 in FIG. 4, has the second highest priority, i.e., 1. Subprogram CSU reads and stores car status data provided by the car controllers of the elevator cars in the bank, and it also compares the new data relative to the previous data record to detect events requiring action. Subprogram CSU places subprogram TNC into bid, indicated by dashed line 160, and also subprogram ACR, indicated by dashed line 162, as required by the detected events, and sets a flag for use by function program ACL in response to detected events.

Subprogram TNC, indicated by block 164, has the third highest priority, i.e., 2. Subprogram TNC reads the status of the corridor call registers and makes a comparison with the previous record to detect the arrival of new calls. New calls are added to a call table CL which keeps a record of the floor number, service direction, and the elapsed time since the call was registered, for each call. The subprogram TNC also detects the cancelling of a corridor call, and removes the call from the call records. Subprogram TNC places subprogram ACL into bid, indicated by dashed line 166.

Subprogram ACL, indicated by block 168 in FIG. 4, has the fourth highest priority, i.e., 3. Subprogram ACL allocates calls to running or busy cars that are suitably conditioned, i.e., located relative to the call and with a service direction such that the car will be able to handle the call as it proceeds on its journey through the building. Any call which cannot be so allocated by subprogram ACL creates a demand signal which signifies that an available car should be assigned to serve the call.

Subprogram ACL registers the demand signal, including a signal identifying the type of demand, but the assignment of an available car to the call is performed in subprogram ACR.

Subprogram ACL normally only allocates new calls detected since it last ran, as the other calls in the call table were processed, i.e., either allocated to busy cars or flagged as demand calls, during previous cycles. However, when a flag or indicator is set by subprogram CSU in response to the detection of an event which may require reallocation of one or more calls, subprogram ACL will process all of the calls in the system. Subprogram ACL places subprogram CHECK into bid, indicated by dashed line 170, or this function may automatically be performed by the priority executive each time control is returned to the priority executive.

Subprogram ACR, indicated by block 172 in FIG. 4, has the fifth highest priority, i.e., 4. Subprogram ACR, which is placed into bidding by subprogram CSU only when there is a demand in the system and there is an available car which can be assigned to the demand, assigns available cars to demands in an order of priority specified by the strategy. A demand may be a single call, or a group of calls from a single zone. Program ACR assigns a car to each demand until all demands are satisfied or no available car remains, and outputs a command to each car it assigns. Subprogram ACR places program CHECK into bid, indicated by dashed line 174, or as hereinbefore stated relative to subprogram ACL, the priority program may place subprogram CHECK into bid each time it obtains control.

Subprogram CHECK, indicated by block 176, may simply place subprogram CSU into bid, indicated by dashed line 178, and it may additionally be used to check for computer failure, and then automatically disconnect the computer or system processor should some predetermined action of the computer fail to satisfy a predetermined requirement.

Subprogram TIME indicated by block 154 in FIG. 4, which has the highest priority of zero, decrements all of the clock counters by which the computer controls the timing of certain of its actions. For example, it controls the clock for timing how long the car stands at the main floor, and the elapsed time each corridor call has been registered.

In certain installations, where the running of the strategy programs ACL and ACR may result in excessive running times, the interrupt executive may place subprograms CSU and TNC into bid on a time basis. For example, if the subprogram CSU has not run for a predetermined period of time, such as 0.4 second, it may be placed into bid by the interrupt executive, as indicated by dashed line 180. If subprogram TNC has not run for a predetermined period of time, such as 0.7 second, it may be placed into bid by the interrupt executive, as indicated by dashed line 182. In most installations, however, the subprograms CSU and TNC will normally run frequently enough that timed bidding by the interrupt executive will not be required.

The bidding structure among the subprograms in FIG. 4 is indicated by dashed lines, and the flow or sequence of the running of the subprograms is indicated by solid lines between the blocks. It will be noted that the function programs run in two main loops. The first main loop includes function programs CSU-TNC-ACL-CHECK-CSU, and the second main loop includes function programs CSU-TNC-ACL-ACR-CHECK-CSU. The second main loop only occurs when a demand has been created due to the non-allocation of a call to a suitable busy car by subprogram ACL, and subprogram CSU determines that there is a car available for assignment to the demand and accordingly places subprogram ACR into bid. Even though subprogram CSU places subprogram ACR into bid, it also places subprogram TNC into bid, and when CSU completes its running, the priority executive runs TNC since it has a higher priority than ACR. Subprogram TNC then places subprogram ACL into bid. Thus, when TNC returns control to the priority executive, it runs ACL because it has a higher priority than ACR. When subprogram ACL is completed, subprogram ACR then runs because it has a higher priority then CHECK. Subprogram ACR runs until all demands have been satisfied, or there are no available cars to assign to demands, and then returns control to the priority executive which runs subprogram CHECK. Subprogram CHECK bids subprogram CSU and the loop which is followed on the next running of the program depends upon whether or not CSU bids ACR.

While the block diagram of FIG. 4 indicates that selected function subprograms run and place other subprograms into bid, it is to be understood that the steps for determining whether a specific subprogram has a need to run may be outside the subprogram, just as it is for subprogram ACR. The need for subprograms CSU, TNC and ACL may be determined outside these programs and if they have a need to run they may then be placed into bid. For example, instead of entering subprogram TNC to find out if there are any new calls, this step could be performed outside TNC and TNC placed into bid only when the program has something to do. In the specific embodiment of the invention the step for determining the need for subprograms CSU, TNC and ACL are determined within the program, and if they have a need to run they, in effect, put themselves into bid by branching into the necessary steps to take the required action. If they have no need to run, the program is exited when this is determined.

Before describing the subprograms of the software package in detail, certain of the tables kept by the software in the memory, or referred to by the software, will be described.

FIG. 5

Figure 5:
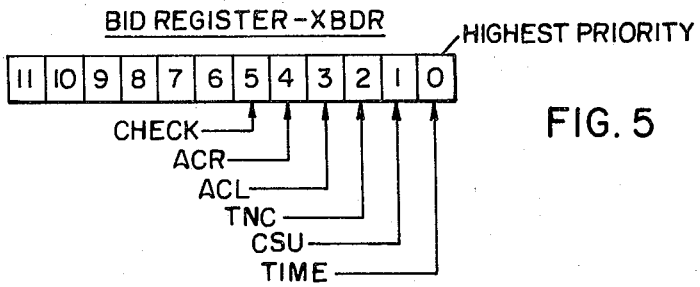
FIG. 5 is a diagrammatic representation of a bid register used by the software system to determine the most efficient linkage of subprograms during each running of the program in response to traffic conditions being experienced by the elevator system.

FIG. 5 illustrates the bid register XBDR referred to by the priority executive at the completion of a function program to determine the highest priority program bidding to run. When a program is placed into bid, its associated bit of the bid register is set to logic one. The bid register is a 12 bit word, with only the 6 bits starting from zero being used. Subprogram TIME, having the highest priority, is associated with bit zero, the subprogram CHECK, having the lowest priority, is assigned to bit 5.

FIG. 6

Figure 6:
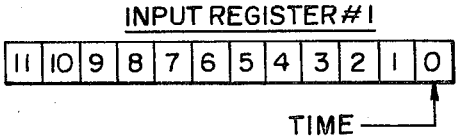
FIG. 6 is a diagrammatic representation of input register number 1 shown in FIG. 2, illustrating its use for interrupts, such as a time interrupt.

FIG. 6 illustrates the 12 bits of input register No. 1, referred to with reference numeral 126 in FIG. 2. Input register No. 1 is used as an interrupt register, as hereinbefore described, with bit zero being set to a logical one in response to a signal from the time interrupt generator 130. Any additional hardware interrupts would be assigned to other bits of input register No. 1.

FIG. 7

Figure 7:
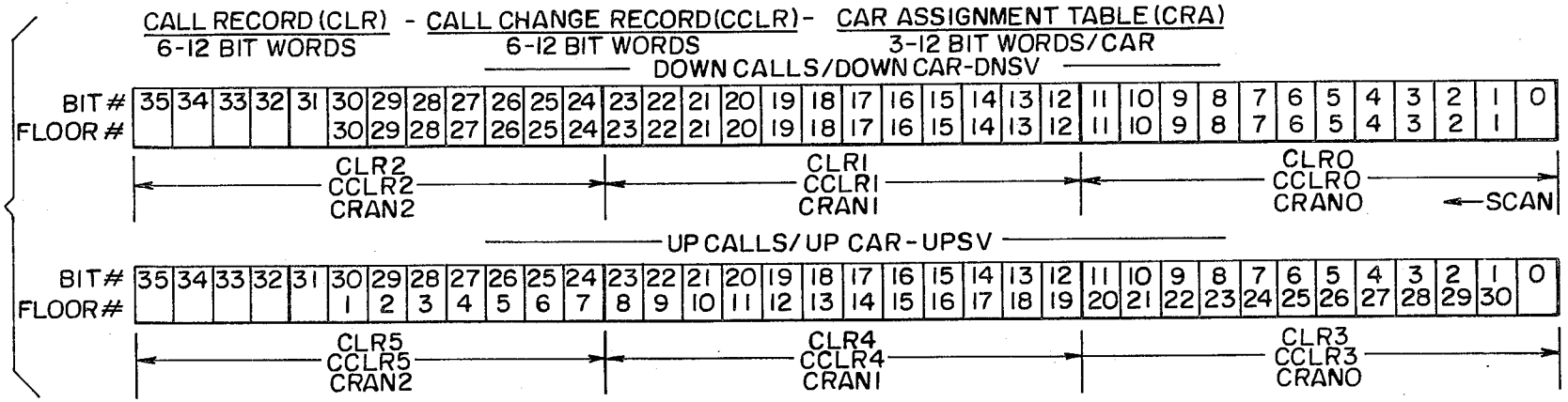
FIG. 7 is a diagrammatic representation of a call record, call change record, and a car assignment table established by the software system for keeping track of corridor calls, and the allocation or assignment of the corridor calls to the various elevator cars of the system.

FIG. 7 illustrates the call record CLR, the call changed record CCLR, and car assignment table CRA. While these records use different memory locations in the memory 112 shown in FIG. 2, they are illustrated in a consolidated manner in FIG. 7 for convenience.

When the corridor call registers are read, the information is stored in a memory location which includes six 12-bit words for a building having up to 36 floors. This is the call record CLR, with the calls being stored therein on a one bit per floor per direction basis. Words CLR0, CLR1 and CLR2 provide 36 bits and thus room for storing down calls from up to 36 floors. The floors may be assigned to like numbered bits, numbering the bits and floors starting from the right-hand side of the down call record. Words CLR3, CLR4 and CLR5 provide 36 bits and room for storing up calls from up to 36 floors. The bits of these words are numbered starting from the right side of the call record, and the floors are assigned to bits starting floor No. 1 from the highest numbered bit used in the down call record.

The call change record CCLR follows the same format as the call record CLR, and its six words CCLR0 through CCLR5 are in the same core region. When the latest call record is compared with the immediately preceding one, a bit is set in the call change record for each change. Thus, a new up or down corridor call will set a bit in the call change record, since a set bit appears for this floor in the latest reading of the corridor call register but not in the previous reading. In like manner, a canceled corridor call, i.e., one that was answered, will set a bit in the call change record since a set bit appears for the associated floor in the previous record but not in the latest reading.

Car assignment table CRA contains three words per car for a building having up to 36 floors, with the convention used for up service (UPSV) cars and down service (DNSV) cars being the same as used for storage of up and down corridor calls, respectively, in the call record CLR. The specific convention used is determined by the service direction of the car. Thus, when the service direction of a car is down, its three words CRAN0 through CRAN2 of its assignment table will have the convention of the upper table in FIG. 7, and when the service direction is up, its three words CRAN0-CRAN2 will have the convention of the lower table in FIG. 7. When a program allocates a call to a car, or assigns a car to a specific floor, it sets an indicator or bit for the floor in question in the car's assignment table CRA. If the car is a running car and the call is allocated to it by program ACL, the program, in addition to setting the bit associated with the floor of the call in the car's assignment table, must check to see if this call is closer than the stop previously sent to the car, and if so, it must replace the "next stop" address with the address of this call. If the car is an available car being assigned to a demand call by program ACR, in addition to placing the call in the car assignment table of the car, it must assign the service direction for the car, give it a start signal, and send the address of the floor to the car. If the demand has several calls associated with it, such as a number of high zone up calls, all the calls associated with the demand are placed in the car assignment table CRA of the car, and the floor address of the first stop is sent to the car.

FIG. 8

Figure 8:
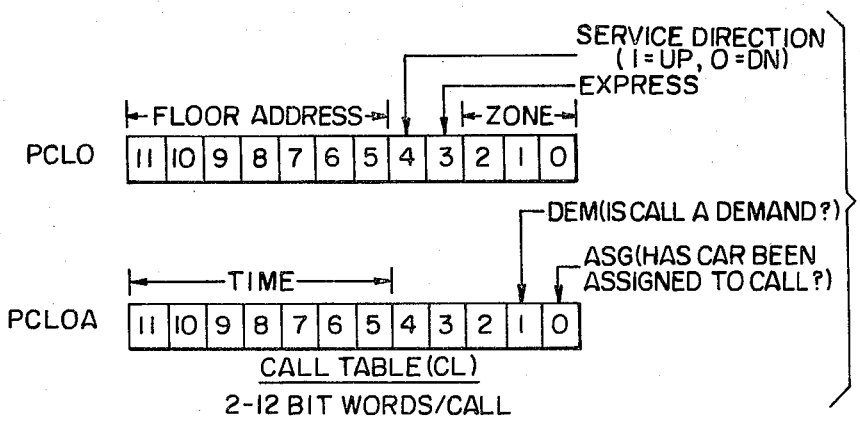
FIG. 8 is a diagrammatic representation of a call table established by the software system, illustrating the two words placed into the call table for each corridor call.

FIG. 8 illustrates the call table CL wherein two 12-bit words are kept for each corridor call. The first word PCLO maintains a 3-bit binary word corresponding to the zone of the call (bits 0–2), bit 4 of the word establishes the service direction of the call, with a logical one indicating up and a logical zero indicating down, the bits 5 through 11 are the address of the floor in binary. The second word associated with each call, referred to as PCLOA, uses bit 1 to flag whether or not the call is a demand call and bit 0 to indicate whether or not a car has been assigned to the floor of the call. Bits 5 through 11 are used by the call timer, which is set to the timed out value when the call is first stored in the call record. This time is decremented on each running of the subprogram TIME, going negative when the call times out.

FIG. 9

Figure 9:
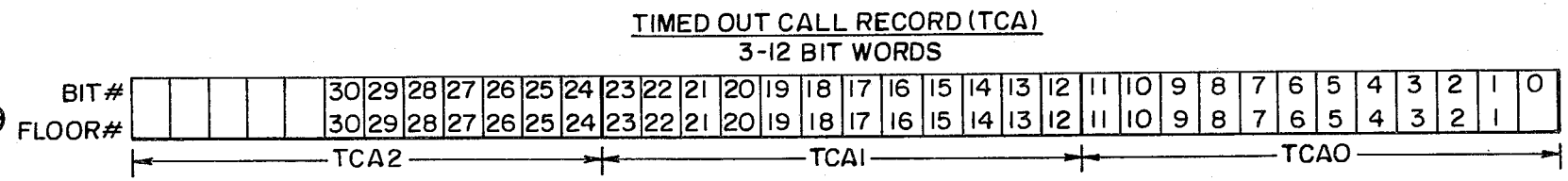
FIG. 9 is a diagrammatic representation of a timed out call record established by the software system, for keeping track of corridor calls registered for longer than a predetermined period of time.

FIG. 9 illustrates a timed out call record TCA, which consists of three 12-bit words TCA0-TCA2 for up to 36 floors. The same convention applies as heretofore explained relative to the call record CLR.

FIG. 10

Figure 10:
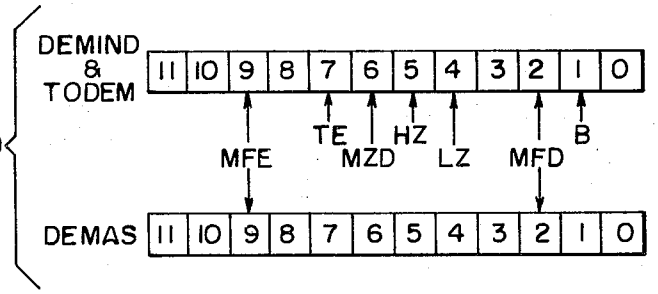
FIG. 10 is a diagrammatic representation of words established by the software system to keep track of system demands, the types of demands, and whether a car has been assigned to certain of the demands.

FIG. 10 illustrates data words DEMIND, TODEM, and DEMAS. Word DEMIND is a demand indicator word, with bits of the word being assigned to different types of service demands. For example, a main floor demand for service to a top extension floor (MFE) is assigned to bit 9, a top extension floor demand (TE) is assigned to bit 7, a main zone down demand (MZD) is assigned to bit 6, a high zone up demand (HZ) is assigned to bit 5, a low zone up demand (LZ) is assigned to bit 4, a main floor demand (MF) is assigned to bit 2, and a basement demand (B) is assigned to bit 1. A demand thus sets a bit in DEMIND corresponding to the type of demand registered.

Word TODEM is used for timed out demands, and uses the same convention as DEMIND. A demand registered for a predetermined period of time sets a bit in TODEM corresponding to the type of demand. When a car is assigned to a demand, the corresponding bit in DEMIND is reset to zero, but the corresponding bit in TODEM is not reset to zero until the call is actually answered by the car.

Words DEMAS in an indicator word. When a car has been assigned to answer a main floor demand (MFD) or a demand from the main floor for the extension (MFE), a bit is set in DEMAS corresponding to the demand bit in DEMIND. The bit is turned off in DEMAS when the car responds and the call is canceled.

FIG. 11

Figure 11:
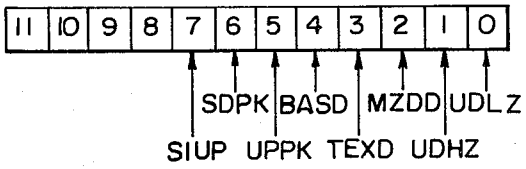
FIG. 11 is a diagrammatic representation of a system signals word established by the software system to keep track of certain types of system demands.

FIG. 11 illustrates a system status word SYSW which has bits set corresponding to different system conditions. For example, bit 7 may be associated with intense up traffic (SIUP), bit 6 with down peak (SDPK), bit 5 with up peak (UPPK), bit 4 with a basement demand (BASD), bit 3 with a top extension demand (TEXD), bit 2 with main zone down demand (MZDD), bit 1 with an up demand in the high zone (UDHZ), and bit 0 with an up demand in the low zone (UDLZ).

FIG. 12

FIG. 12 illustrates the three 12-bit input words IW0, IW1 and IW2 which are sent to the system processor from each car controller. These input words provide status data relative to each car which the system processor uses in determining its strategy and corridor call assignments. The information conveyed by the symbols in these input words is listed in the symbol and signal identification table hereinafter set forth.

FIG. 13

FIG. 13 illustrates the three 12-bit output words OW0, OW1 and OW2 which are sent to each car controller by the system processor. These words include the various commands sent to each elevator car by the system processor, in order to dispatch the cars and answer corridor calls according to the programmed strategy. The information conveyed by these words may also be obtained by looking up the appropriate symbol in the table hereinafter set forth.

FIG. 14

FIG. 14 illustrates an additional or extra memory word maintained for each car, to further aid the system processor in keeping track of each car. The information contained in this extra word may also be identified by referring to the listing of signals and program identifiers.

FIG. 15

FIG. 15 illustrates how a building may be zoned and coded, to provide a zone code used by the system processor to keep track of corridor calls, demands, and the elevator cars. A call for up or down service, or a car set for up or down service, uses the zone code of 1 for the basement (B), the zone code 2 for the main floor (MF), and 7 for the top extension (TE). An up service call, or a car set for up service uses zone codes 4 and 5 for floors between the main floor and top extension, divided into low and high zones LZ and HZ, respectively. A call for down service, or a car set for down service, associated with the floors between the main floor and top extension (MZD), uses a zone code of 6. A car with no assignment is given a zone code of 0. If the building has a middle express zone at which no cars stop, this group of floors may be given the zone code of 3.

In describing the software programs shown in FIG. 4 in detail, it will be helpful to set forth the program identifiers used in the flow charts, as well as the various signals and symbols used in the discussion of the flow charts. The following listing of symbols and their functions also include the signals used in the input words, output words, and extra word, shown in FIGS. 12, 13 and 14.

| Symbol | Description |
|---|---|
| ACC- | Accumulator register |
| ACIN- | Serial input signal to accumulator register |
| ACL- | Subprogram for allocating calls |
| ACLFLR- | Call floor |
| ACLϕCR | Car number of closest suitable car found so far |
| ACLMCR- | Call floor minus ACP |
| ACO- | Serial output signal from accumulator register |
| ACP- | Advanced car position |
| ACPA- | Parallel output signal from accumulator register |
| ACR- | Subprogram for assigning available cars |
| ACRFLR- | ACP of car being processed |
| ACRMSK- | Zone mask-exposes zone of call for car selection |
| ADIN- | Serial input signal to memory address register |
| ADO- | Serial output signal from memory address register |
| AHICAR- | Car number of highest car considered so far |
| AHIFLR- | ACP of highest car considered so far |
| ASDIF- | Call floor minus ACP of closest car to call found so far |
| ASFL- | Assigned floor |
| ASG- | Assigned |
| ASGN- | Assigned |
| ATSV- | Attendant service |
| AVAD- | Car available according to system processor |
| AVAS- | Car available according to floor selector |
| AVP0–AVP6- | ACP in binary |
| B- | Basement Zone - Code 1 |
| BASCAP- | Capability to serve basement |
| BASD- | Basement demand - system signal |
| BCC- | Basement car call |
| BDR- | Bid register |
| BNXT- | Basement next |
| BSMT- | Basement assignment signal |
| BYP- | Is car bypassing corridor calls? |
| BYPS- | Signal-Car is bypassing corridor calls |
| CALL- | Signal that car has a car call |
| CALZON- | Zone of call being processed |
| CARZON- | Zone of car being processed |
| CCAB- | Car call above ACP |
| CCAI- | Inhibits car from answering car calls |
| CCBL- | Car call below ACP |
| CCLR- | Call change record |
| CCLR0–CCLR5- | Word names in CCLR |
| CL- | Call table |
| CLR- | Call record |
| CLR0–CLR5- | Word names in CLR |
| CRA- | Car assignment table |
| CRAn0–CRAn2- | Word names in CRA |
| CREG- | Car call registered signal |
| CRNO- | Car number |
| CSU- | Subprogram for bringing status of cars up to date |
| DCLO- | Close car door signal from processor |
| DEC- | Signal that car has started to decelerate |
| DECR- | Decrement |
| DEM- | Demand |
| DEMAS- | Indicator word - used to indicate when a car has been assigned to MFO and MFE demands |
| DEMIND- | Demand indicator word - has a bit for each type of service demand |
| DNPK- | car down peak signal |
| DNSV- | Down service signal |
| DϕPN- | Open car door signal from processor |
| DPK- | Down peak timer |
| DRCL- | Signal that car door is closed |
| DS- | Down service |
| DT- | Down travel |
| FAD0–FAD6- | Assigned floor address in binary |
| FDCL- | Indicator - set to zero when highest down call has been processed |
| FL- | Floor |
| GCP- | Gated clock pulses |
| HI- | HIGH |
| HIFLR- | ACP of highest car considered so far |
| HIZON- | High zone |
| HLMO- | Hall lantern signal |
| HLMI- | Hall lantern signal |
| HZ- | High zone up - Code 5 |
| I.E.- | Subprogram - Interrupt Executive |
| INCR- | Increment |
| INSC- | Car in service signal |
| IRIN- | Serial input signal to instruction register |
| IRO- | Serial output signal from instruction register |
| IRP- | Parallel output signal from instruction register |
| IS- | In service |
| IW0–IW2- | Input words to system processor |
| JMP- | Jump |
| LKA- | Bit selection mask used in Subroutine LOOK |
| LKO- | Bit selection mask used in Subroutine LOOK |
| Lϕ- | Low |
| LϕBMZD- | Indicator set when an available car has been assigned to main zone down service |
| LOOK- | Subroutine |
| LSB- | Least significant bit |

-continued

| Symbol | Description |
|---|---|
| MAXCRN- | Highest number assigned to a car |
| MBIN- | Serial input signal to memory buffer register |
| MBO- | Serial output signal from memory buffer register |
| MCCR- | Master car call reset |
| MF- | Main floor zone - Code 2 |
| MFD- | Main floor demand |
| MFL- | Main floor number |
| MFTIM- | Timer which runs when no car at main floor |
| MFS- | Main floor start |
| MFSTIM- | Main floor start timer |
| MFX- | Indicator set when a car is expressing to main floor |
| MFU- | Indicator set when there is a main floor up call |
| MNFL- | Signal which indicates ACP is at main floor |
| MϕD0- | Floor address mode signal |
| MϕD1- | Floor address mode signal |
| MSB- | Most significant bit |
| MSK- | Mask |
| MZD- | Main zone down - Code 6 |
| MZDD- | Systems signal - main zone down demand |
| MZDSWP- | Indicator - non-zero during second loop when processing highest down call |
| NAC- | Number of in service cars available |
| NCL- | Number of calls in call table CL |
| NEXI- | Indicator - indicates there is a next car when non-zero |
| NEXT- | Car next signal for next car to leave main floor |
| NMCRO- | Number of cars in system |
| NOSC- | Number of cars out of service |
| NTOD- | Number of timed out down calls |
| NXTIM- | Next timer |
| OCRNO- | Car number |
| ϕW0-ϕW2- | Output words from system processor to cars |
| PARK- | Park signal from processor |
| P.C.- | Program counter register |
| PCALLC | Pointer to address of first word of call table |
| PCIN- | Serial input signal to program counter register |
| PCLO- | Address ptr. of call table - 1st word of call being processed |
| PCLOA- | Address ptr. of call table - 2nd word of call being processed |
| PCLOAX- | Local address of PCLOA |
| PCLOX- | Local address of PCLO |
| PCLV- | Temporary storage address for call table address being processed |
| PCO- | Serial output signal from program counter register |
| PIN1-O- | Output signal from input register No. 1 |
| PIN2-O- | Output signal from input register No. 2 |
| PTR- | Pointer |
| QTOD- | Quota of T.O. down demands |
| REFLR- | Floor No. of call being processed |
| SASS- | Service assignment signal from processor |
| SD- | Service direction |
| SDPK- | System down peak signal |
| SIUP- | System intense up traffic signal |
| SLDN- | Car slowing down signal |
| SPMCR- | Indicator which is non-zero when a Zone 6 ASG car has been given a down corridor call |
| STRP- | Indicator which is non-zero when door light beam has not been broken for a predetermined time |
| STT- | Basement signal |
| SYSMFX- | System has a car which is expressing to main floor |
| SYSW- | System signals word |
| TASS- | Travel assignment signal from processor |
| TBITN- | Bit number used to load information from corridor calls |
| TCA- | Timed out call record |
| TCA0-TCA2- | Word names in TCA |
| TD- | Travel direction |
| TE- | Top extension zone - Code 7 |
| TEXD- | System signal for TE demand |
| TNC- | Subprogram for tabulating new calls |
| Tϕ- | Timed out |

-continued

| Symbol | Description |
|---|---|
| TϕDEM- | Timed out demand indicator |
| TϕM- | Indicator which when non-zero indicates MFTIM has timed out |
| UDHZ- | System signal - up demand in high zone |
| UDLZ- | System signal - up demand in low zone |
| UPK- | Up peak indicator - non-zero during up peak |
| UPPK- | System signal - up peak |
| UPSV- | Up service signal |
| UPTIM- | Up peak timer - positive during up peak |
| UPTR- | Up travel signal |
| US- | Up service |
| UT- | Up travel |
| VTMI- | Storage location |
| WN- | Variable used in timer program |
| WT50- | Car load signal indicating 50% of capacity |
| WT75- | Car load signal indicating 75% of capacity |
| XBDR- | Bid register |
| XI- | Variable used to indicate the number of the car being processed |
| XW- | Extra word |
| YCALL- | Call word created in TNC for XOR with CLR word to obtain CCLR |
| YNCLO- | Counts number of processed calls in call table as opposed to new calls |
| ZACLBD- | Indicator - when non-zero it requests ACL to reprocess all calls in call table CL |
| ZACP- | Image of ACP at start of processing run through program |
| ZACPMF- | Variable set to the advanced car position minus main floor |
| ZCCI- | Indicator - when non-zero it indicated a car call has been registered in the "next" car |
| ZI- | The number of the car being processed |
| ZINIT- | Indicator - zero during first run through CSU and one thereafter |
| ZIW0- | Image of input word IW0 at start of CSU |
| ZIW1- | Image of input word IW1 at start of CSU |
| ZIW2- | Image of input word IW2 at start of CSU |
| ZMDC- | Counter - No. of cars qualifying to answer MFD |
| ZNMC- | Counter - No. of cars at main floor excluding those with BSMT assignment |
| ZONE- | Code identifying location of calls and service direction, and location of car |
| ZϕW0- | Image of output word ϕW0 at start of CSU |
| ZϕW1- | Image of output word ϕW1 at start of CSU |
| ZϕW2- | Image of output word ϕW2 at start of CSU |
| ZXW- | Image of extra word at start of program run |
| I-VI- | Cycle states of system processor |
| 32L- | Signal indicating car is moving |

FIG. 16

Figure 16:
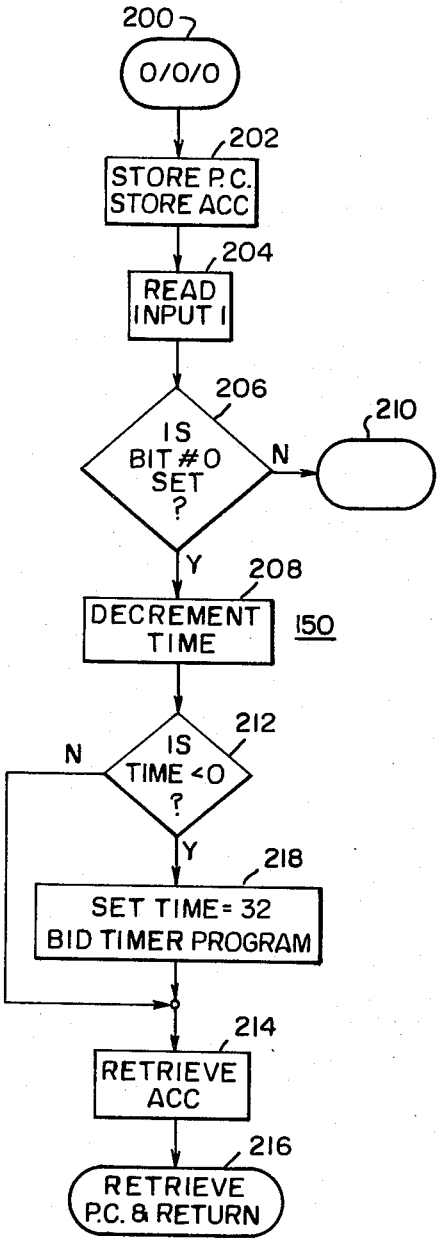
FIG. 16 is a flow chart illustrating a subprogram which may be used for the block software function entitled "Interrupt Executive" in FIG. 4.

FIG. 16 is a flow chart of an interrupt executive program which may be used for the function shown as block 150 in FIG. 4. The interrupt executive program starts at terminal 200 in response to a timing interrupt initiated by the time interrupt generator 130 shown in FIG. 2; or, when the computer is first taking control of the system and the program has been started at the hexadecimal address $000_{16}$. The interrupt executive, in step 202, stores the information which is currently in the program counter 84 and in the accumulator 92, and in step 204 input register No. 1 is read. Input register No. 1 is illustrated in block form as register 126 in FIG. 2, and the 12 bits of the register are shown in FIG. 6. Step 206 checks bit 0 to see if it is set (i.e., a logical one). If this bit is set, it indicates a timing interrupt and the timer is decremented in step 208. If this bit is not set, i.e., it is a logical zero, it indicates the computer has just taken control and the program is at address $000_{16}$. In this event, the program leaves the interrupt executive program at terminal 210 to follow certain initialization procedures, as will be hereinafter explained.

If the entry into the interrupt executive was for a timing interrupt, the time is checked in step 212 to see if the time is less than zero. If the time is not less than zero, the contents of the accumulator and program counter are retrieved in steps 214 and 216, respectively, and the program running at the time of the interrupt is reentered at the same point that it was at the time of the interrupt.

If the time is less than zero, it indicates that it has been 3.2 seconds since the timer program last ran, and the timer is set to 32 and the timer program is placed in bid in step 218. Steps 214 and 216 are then followed to resume the program which was running. When the running is completed and control is returned to the priority executive, the subprogram TIME, bid by step 218, will run since it has the highest priority.

FIG. 17

Figure 17:
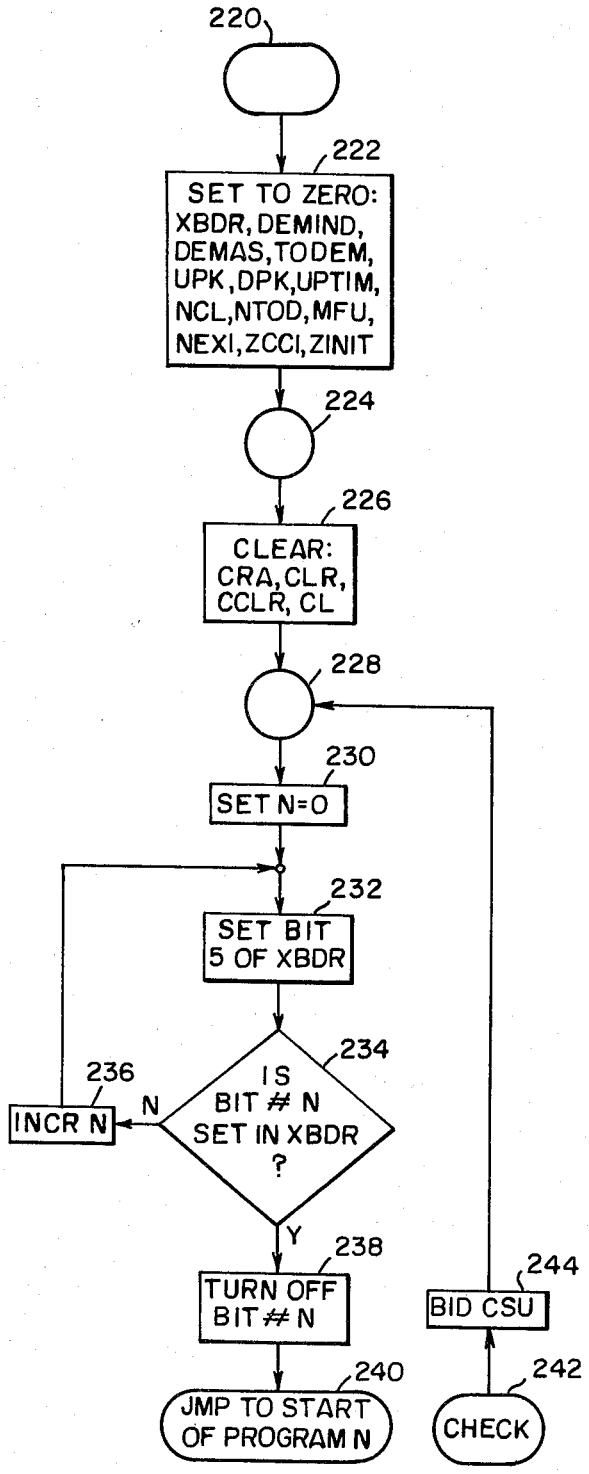
FIG. 17 is a flow chart illustrating a subprogram which may be used to establish the linkages between the subprograms of the software system shown in FIG. 4, in response to the bid register shown in FIG. 5.

FIG. 17 is a flow chart which illustrates an initialization procedure and the priority executive. If the program was started at hexadecimal address $000_{16}$ and thus the interrupt executive 150 followed the path to terminal 210, an initialization procedure starting at terminal 220 of FIG. 17 would be followed. As shown in step 222, this includes setting to zero the bid register XBDR, the demand word DEMIND, the indicator word DEMAS, the timed out demand indicator TODEM, the up and down peak indicators UPK and DPK, respectively, the up peak timer UPTIM, indicator NCL which indicates the number of calls in the call table CL, indicator NTOD for the number of timed out down calls, indicator MFU for a main floor up call, indicator NEXI for "next" car, indicator ZCCI for a car call in the "next" car, and indicator ZINIT for indicating the first run through subprogram CSU. The program then follows the path through terminal 224 to step 226, which clears the car assignment table CRA, the call record CLR, the call change record CCLR, and the call table CL, shown in FIGS. 7 and 8. This completes the initialization steps, and the priority executive is entered at terminal 228.

The function of the priority executive is to start at the highest priority bit, i.e., bit 0, of the bid register XBDR shown in FIG. 5, and run the highest priority program which is bidding to run. Therefore, the first step 230 is to set the pointer to bit 0 of the bid register. The program CHECK is then placed in bid in step 232 by setting bit 5 of the bid register. Each bit of the bid register is successively checked, starting from bit 0, by steps 234 and 236, and when a set bit is found, this bit is turned off in step 238 and the program jumps to the start of this program at terminal 240. If none of the function programs were bidding to run, the subprogram CHECK would be run as it was placed in bid by the priority executive during step 232. Subprogram CHECK may be an active program, which checks the computer logic for malfunction; or, as illustrated in FIG. 17, it may simply be a dummy program entered at terminal 242 which has a single step 244 for placing subprogram CSU into bid by setting bit 1 of the bid register XBDR to a logic one, and then returns to terminal 228 of the priority executive. Thus, when the computer is first taking control, the priority executive starts the active program with program CSU by bidding the subprogram CHECK. Subprograms ACL and ACR thus effectively place subprogram CHECK into bid when they return control to the priority executive, since the priority executive bids the subprogram CHECK for them.

FIG. 18

Figure 18:
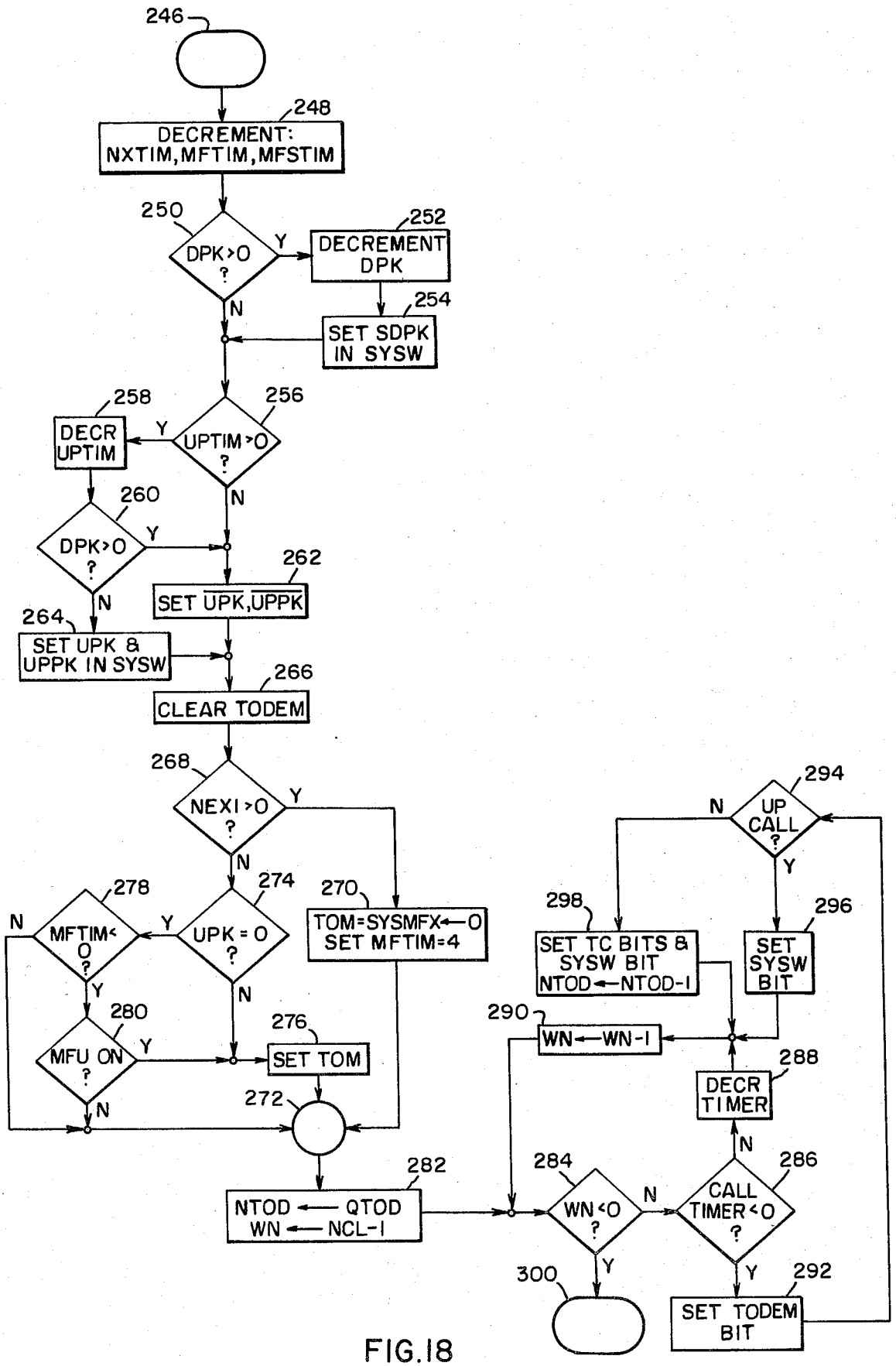
FIG. 18 is a flow chart illustrating a subprogram which may be used for the block software function entitled "Time" in FIG. 4.

FIG. 18 is a flow chart of a subprogram TIME which may be used for the function shown as block 154 in FIG. 4. Subprogram TIME is entered at terminal 246 and step 248 decrements timers NXTIM, MFTIM and MFSTIM. Timer NXTIM controls the time for dispatching the "next" car from the main floor, timer MFTIM runs when there is no car at the main floor, and timer MFSTIM is the main floor start timer. The down peak timer DPK is checked in step 250 to determine if it is greater than zero, and if it is, indicating a down peak condition, the down peak timer is decremented in step 252 and the system down peak SDPK is set in the system signals word SYSW shown in FIG. 11.

The up peak timer UPTIM is then checked in step 256 to see if it is greater than zero. If it is, indicating an up peak condition, the down peak timer DPK is checked to see if it is greater than zero, as down peak predominates up peak if both occur at the same time. If a down peak condition is occurring $\overline{\text{UPK}}$ and $\overline{\text{UPPK}}$ are set to logic one in step 262. If an up peak is occurring in the absence of a down peak, UPK and UPPK are set to logic one in step 264. If an up peak is not occurring, step 256 proceeds directly to step 262, setting $\overline{\text{UPK}}$ and $\overline{\text{UPPK}}$ to logic one. The timed out demand word TODEM, shown in FIG. 10, is cleared in step 266, and the indicator NEXI is checked in step 268. If NEXI is greater than zero it indicates there is a "next" car, and when it is zero it indicates there is no "next" car. If there is a "next" car, step 270 sets indicators SYSMFX and TϕM to zero, both of which are associated with the function of obtaining a car for the main floor when there is no "next" car. The main floor timer MFTIM is set to four in step 270, and is continually reset to four as long as there is a car at the main floor. The program then proceeds to terminal 272.

If step 268 determines that there is no "next" car, the up peak indicator UPK is checked in step 274. If an up peak is occurring and UPK is set, indicator TϕM is set in step 276 and the program advances to terminal 272. When an indicator or a bit is indicated as being set, it indicates that it is set to a logic one. If the up peak UPK is not set, the main floor timer MFTIM, which runs when there is no car at the main floor, is checked in step 278 to see if it has timed out. If it has not timed out, the program advances to terminal 272. If it has timed out, step 280 checks to see if there is an up call registered at the main floor, and if there is, indicator TϕM is set in step 276. If there is no up call at the main floor, i.e., MFU is not set, the program advances to terminal 272.

The subprogram TIME now checks every call in the call table CL for timing out. Step 282 sets the number of timed out down calls NTOD to the quota QTOD which will initiate up call bypass. Step 282 also sets the variable WN to the number of calls in the call table CL minus 1, in order to provide a negative number when all the calls in the call table have been processed. WN is tested in step 284 to determine if all calls have been processed, and if not, the call timer of the call is checked in step 286 to see if it has timed out, i.e., is it negative? If it is not timed out, the timer for this call is decremented in step 288 and the next call, if any, is considered by setting WN equal to WN-1 in step 290. If a call if found whose timer has timed out, the associated bit in the timed out demand word TODEM, illustrated in FIG. 10, is set in step 292. The call is checked in step 294 for service direction. If it is an up call, step 296 sets the associated bit in the systems word SYSW, and if it is a down call, step 298 sets the associated bit in the timed out call record TCA, shown in FIG. 9. Step 298 also sets the number of timed out down calls NTOD to NTOD minus 1. Then, for both up and down calls, the program advances to step 290 to process the next call. When all calls have been processed, step 284 exits the subprogram TIME via terminal 300, returning to terminal 228 of the priority executive shown in FIG. 17.

FIG. 19

Figure 19:
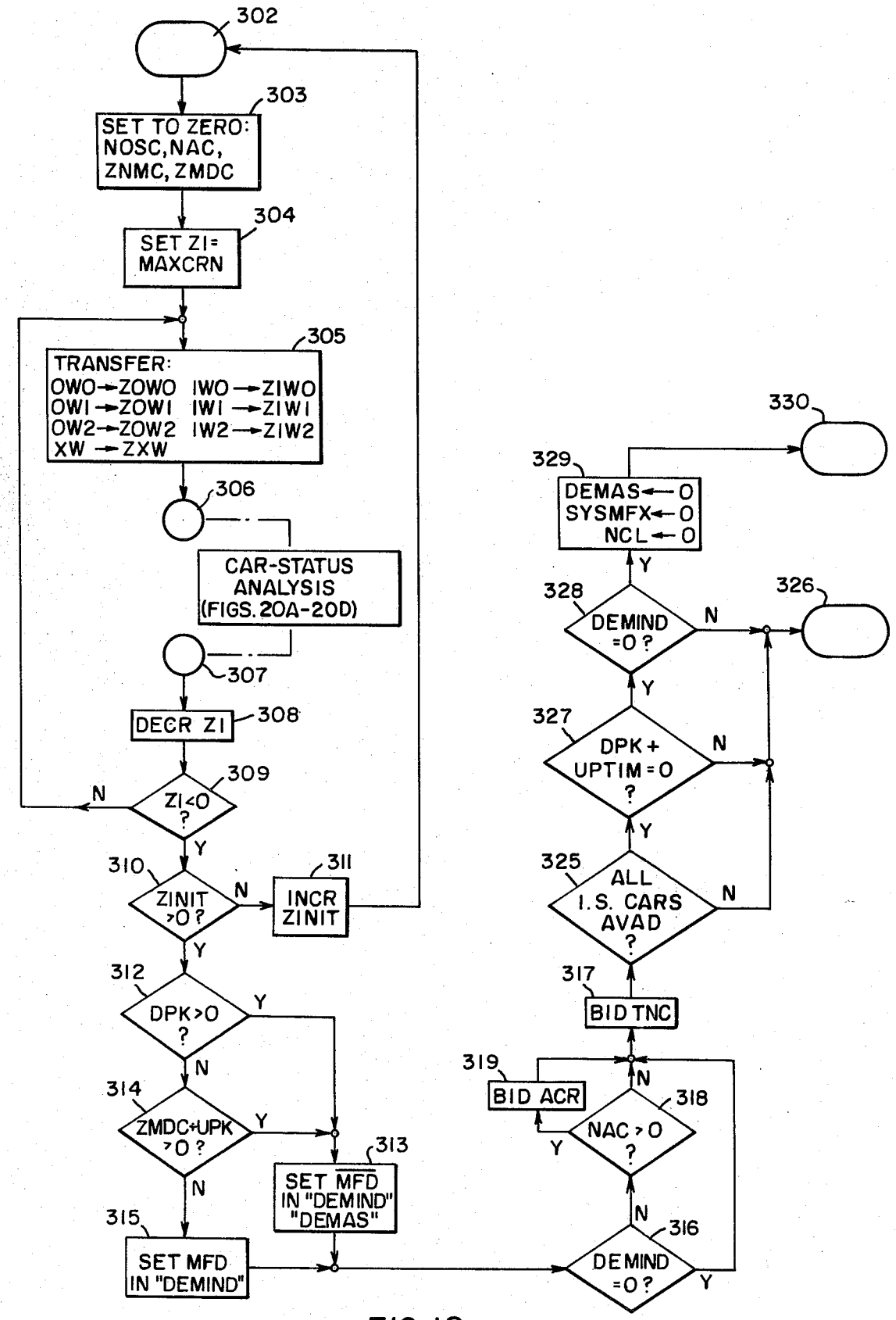
FIG. 19 is a flow chart illustrating a subprogram which may be used for the block software function entitled "CSU" in FIG. 4.

FIG. 19 is a flow chart of subprogram CSU, which, along with the flow chart shown FIGS. 20A, 20B, 20C and 20D, may be used for the function 158 shown in block form in FIG. 4. Subprogram CSU starts at terminal 302, and in step 303 it sets to zero the number of out-of-service cars (NOSC), the number of available cars (NAC), the number of cars at the main floor, excluding those with a basement assignment (ZNMC), and the number of cars qualifying as answering a main floor demand (ZMDC). Step 304 sets the variable Z1 equal to the highest number assigned to an elevator car, i.e., number 3 for a 4 car system, starting the numbering from zero. Step 305 forms an image of the output words OW0, OW1 and OW2, an image of the input words IW0, IW1 and IW2, and an image of the extra word XW, for the first car to be processed for use during the analysis. The car status analysis starts at terminal 306 and ends at terminal 307. The car status analysis between these terminals is shown in FIGS. 20A, 20B, 20C and 20D, and will be hereinafter described.

After the car status analysis for the car in question is completed, step 308 decrements Z1, and Z1 is then checked in step 309 to see if there is still another car to be considered. If there is still one or more cars to consider, the program returns to step 305 for the next car and its analysis is performed.

When all cars have been considered, the indicator ZINIT is checked in step 310 to see if this is the first run of subprogram CSU following start up of the system. If it is the first run, ZINIT is set non-zero in step 311 and the program returns to terminal 302. The first car status analysis following start up of the system is not an in-depth analysis, as will be observed when FIGS. 20A through 20D are described.

If this was not the first run through subprogram CSU following start up, the program advances to step 312 which checks the down peak timer DPK. The down peak timer DPK is positive during a down peak condition, and if it is positive, the program advances to step 313 which sets the bits $\overline{\text{MFD}}$ in the DEMIND and DEMAS words shown in FIG. 10 associated with the main floor demand. If the down peak timer DPK is not positive, step 314 checks to see if there are any cars which qualify to answer a main floor demand, or if the system is in up peak. If any cars qualify, counter ZMDC will be positive, or if the system is in up peak, the up peak indicator UPK will be positive, and the program advances to step 313, previously described. If there are no cars which qualify, or if the system is not in up peak, the main floor demand bit MFD is set in DEMIND in step 315, to register a demand for a car at the main floor.

Step 316 checks to see if there are any demands in the system by checking the demand word DEMIND. If there are no demands in the system, subprogram TNC is bid in step 317. If there are demands, it is important to note that subprogram ACR is not automatically placed into bid. First, the system is checked to see if there is an available car which can be assigned to the demand. If there are none, counter NAC will be zero when it is checked in step 318 and subprogram CSU places subprogram TNC into bid in step 317. If there is a demand and an available car, subprogram ACR is bid in step 319, and then subprogram TNC is bid in step 317. If both TNC and ACR are placed into bid, TNC will run before ACR since it has a higher priority, as pointed out relative to the program bidding and flow structure in FIG. 4.

Step 317 advances to step 325, which checks to see if all in service cars are available according to the system processor (AVAD). If all in service calls are not AVAD, program CSU exits at terminal 326 and the program returns to terminal 328 of the priority executive. The program also exits from terminal 326 if either the down peak timer DPK or up peak timer UPK are positive, as checked in step 327, or if there is a demand in the system, determined by checking DEMIND in step 328. If all in service cars are AVAD, the system is not on down peak or up peak, and there are no demands in the system, step 329 reinitializes DEMAS, SYSMFX and NCL by setting them to zero and the program exits at terminal 330 which enters terminal 224 of FIG. 17 in order to clear all of the tables in step 226. This insures that a corridor call does not become "lost" for some reason, clearing the call table CL and car assignment registers CRA when all in service cars are available. If an unanswered corridor call is present it will be re-registered in the call record CLR and picked up as a new call in the call change record CCLR, resulting in one of the available cars being assigned to the call.

FIGS. 20A–20D

FIGS. 20A–20D may be assembled to provide a single flow chart for the car status analysis function which is performed for each car between terminals 306 and 307 of subprogram CSU in FIG. 19. The car status analysis starts at terminal 331 and in step 332 ZACP is formed which is an image of the advanced car position of the car whose status is being checked. Step 333 checks ZINIT to see if this is the first run through CSU after start up, and if it is the program advances to terminal 334 (FIG. 20B) and follows the initialization procedures of step 335. This step sets $\overline{\text{BSMT}}$, $\overline{\text{AVAD}}$, $\overline{\text{NEXT}}$, and $\overline{\text{PARK}}$ to logic one, it clears the image of the extra word ZXW, it sets the zone of the car according to the zone code shown in FIG. 15, it sets both of the assignment mode signals MOD0 and MOD1 to logic zero, inhibiting all corridor calls to the car, it sets the travel assignment signal TASS to correspond to the travel direction of the car, and it sets the service assignment signal SASS to correspond to the service direction of the car. The program then advances to terminal 336 (FIG. 20D) where the system down peak timer DPK is checked in step 337. If the system down peak timer is "on", the car indicator DNPK is set in step 338, and if it is not on, $\overline{\text{DNPK}}$ is set in step 339. The three command words OW0, OW1 and OW2 shown in FIG. 13 are then outputted to the car in step 340, the extra word shown in FIG. 14 is updated in step 341, the input data is updated in step 342, and the car status analysis exits at terminal 343, returning to terminal 307 in FIG. 19.

After all cars have been checked by this initial procedure, ZINIT is set to one in step 311 (FIG. 19) of CSU and analysis of the cars starts all over again. This time, step 333 of FIG. 20A will advance to step 344, to check if the car is in service. If it is not in service, counter NOSC for counting the number of cars out of service is incremented in step 345. The car is then checked in step 346 to determine if the car was in service on the previous running of CSU. If it was not in service during the previous running, the program advances to step 342 and the car status analysis is complete for this car, exiting back to terminal 307 of FIG. 19 via terminal 343.

If the car was in service on the last running of CSU but is not now in service, this is an event which requires processing all of the calls in the call table on the next running of ACL, so flag ZACLDB is set in step 347. The car is checked in step 348 to determine if this car is indicated by the system processor as being the next car to leave the main floor. If it is identified as the next car to leave the main floor, indicators NEXI and ZCCI are set to zero in step 418, indicating there is no next car, and the program advances to terminal 334 in FIG. 20B, following the same route described for the first run through the car status analysis immediately following start up. If the car was not next, the program advances directly from step 348 to terminal 334.

If the car is in service, step 349 checks to see if the car was in service during the previous running of CSU. If it was not in service during the previous running, its assignment table CRA is cleared in step 350 and the program advances to terminal 334, which was hereinbefore described.

If the car was in service, the car is checked for a change in its bypass status in step 351, and if there was a change in its bypass status, indicator ZACLBD is set in step 352 to cause subprogram ACL to process all of the calls in the call table.

Variable ZACPMF is then set to the advanced car position minus the main floor in step 353. The car position is checked in step 354 to see whether the advanced car position is below the main floor. If it is, output signal BSMT is set for the car in step 355, and step 356 sets the mode signals MOD0 and MOD1 to give the car a main floor and below assignment, it sets the basement assignment signal STT, as well as to properly set the travel and service assignments. The program then advances to terminal 336 in FIG. 20D, hereinbefore described.

If the advanced car position is not below the main floor, step 354 advances to step 357 and checks to see if signal BSMT is set. If it is not set, the program advances directly to terminal 358. If it is set, the car is checked in steps 359 and 360 to determine if the car is available according to the floor selector (AVAS), and if it is, was it AVAS on the preceding run of CSU. If the car is not AVAS, or is AVAS and was AVAS on the previous running of CSU, the program advances to the basement assignment step 356 hereinbefore described. If the car is AVAS but was not AVAS on the previous running of CSU, the flag ZACLBD is set and $\overline{\text{BSMT}}$ is set in step 361. The change in availability according to the selector is an event requiring ACL to process all of the calls in the call table during its next running, in response to the set indicator ZACLBD, and setting $\overline{\text{BSMT}}$ removes the basement signal to the car. The program then advances to terminal 358.

Step 362 sets $\overline{\text{STT}}$ to turn off the basement signal and checks for basement car calls in step 363. If there is a basement car call, step 364 sets BCC, and if there are no basement car calls, step 365 sets $\overline{\text{BCC}}$.

Step 366 determines if the car is assigned to serve a demand, and if it is, step 367 checks to see if the car is selected as the next car to leave the main floor. If it is "next", signals $\overline{\text{NEXT}}$ and $\overline{\text{AVAD}}$ are set, the door and lantern modes are set normal, and indicators NEXI and ZCCI are set to zero, in step 368. Step 369 (FIG. 20B) sets the master car call reset signal $\overline{\text{MCCR}}$, enabling car calls to be registered in this "next" car, and the program advances to terminal 370. If the car is not next, step 380 sets $\overline{\text{AVAD}}$ and $\overline{\text{MNFL}}$ and the program advances to terminal 370.

If a car is not assigned to a demand, step 366 advances to step 371 which determines if the advanced car position is at the main floor. If it is not at the main floor, step 372 sets $\overline{\text{MNFL}}$ and $\overline{\text{MFS}}$, the output signal which indicates whether the advanced car position is at the main floor, and the main floor start signal, respectively.

Step 373 determines if the car is the next car to leave the main floor, and if it is, the program advances to step 368, hereinbefore described. If it is not "next", the car is checked in step 374 (FIG. 20B) to determine if it has completed its run. If it has not, signal $\overline{\text{AVAD}}$ is set in step 375 and the program advances to terminal 370. If the car has completed its run, it is checked in step 376 to see if it should be made AVAD, i.e., does it have any car calls or demands? If it is suitable to be made AVAD, step 377 sets AVAD, and if not, step 378 sets $\overline{\text{AVAD}}$, and the program advances to terminal 370 via step 369, hereinbefore described. If step 371 determines that the advanced car position is at the main floor, determined by binary input signal AVP0-AVP6 being equal to the binary address of the main floor, step 379 sets MNFL and step 381 checks to see if the car has a main floor start signal. If it does, step 382 checks the main floor start timer MFSTIM to see if it has timed out. If it has timed out, step 383 sets the door and lantern modes normal and the program advances to terminal 384 in FIG. 20D. If timer MFSTIM has not timed out, step 385 checks the car weight, and if it is greater than 75% of capacity, the program advances to step 383, just described. If the car weight is less than 75% of capacity, step 369 (FIG. 20B) enables car calls to be registered and the program advances to terminal 370.

If the car is at the main floor but does not have a main floor start signal, step 386 determines if the car is selected as the next car to leave the main floor. If it is not "next", step 387 determines if the car qualifies as the next car to leave the main floor. If it does not qualify, step 388 sets $\overline{\text{NEXT}}$, and proceeds to step 369, hereinbefore described. If it does qualify as "next", signal NEXT is set in step 389 and the program advances to terminal 390 in FIG. 20C. If step 386 determines that the car is "next", the program also advances to terminal 390.

Figure 20A:
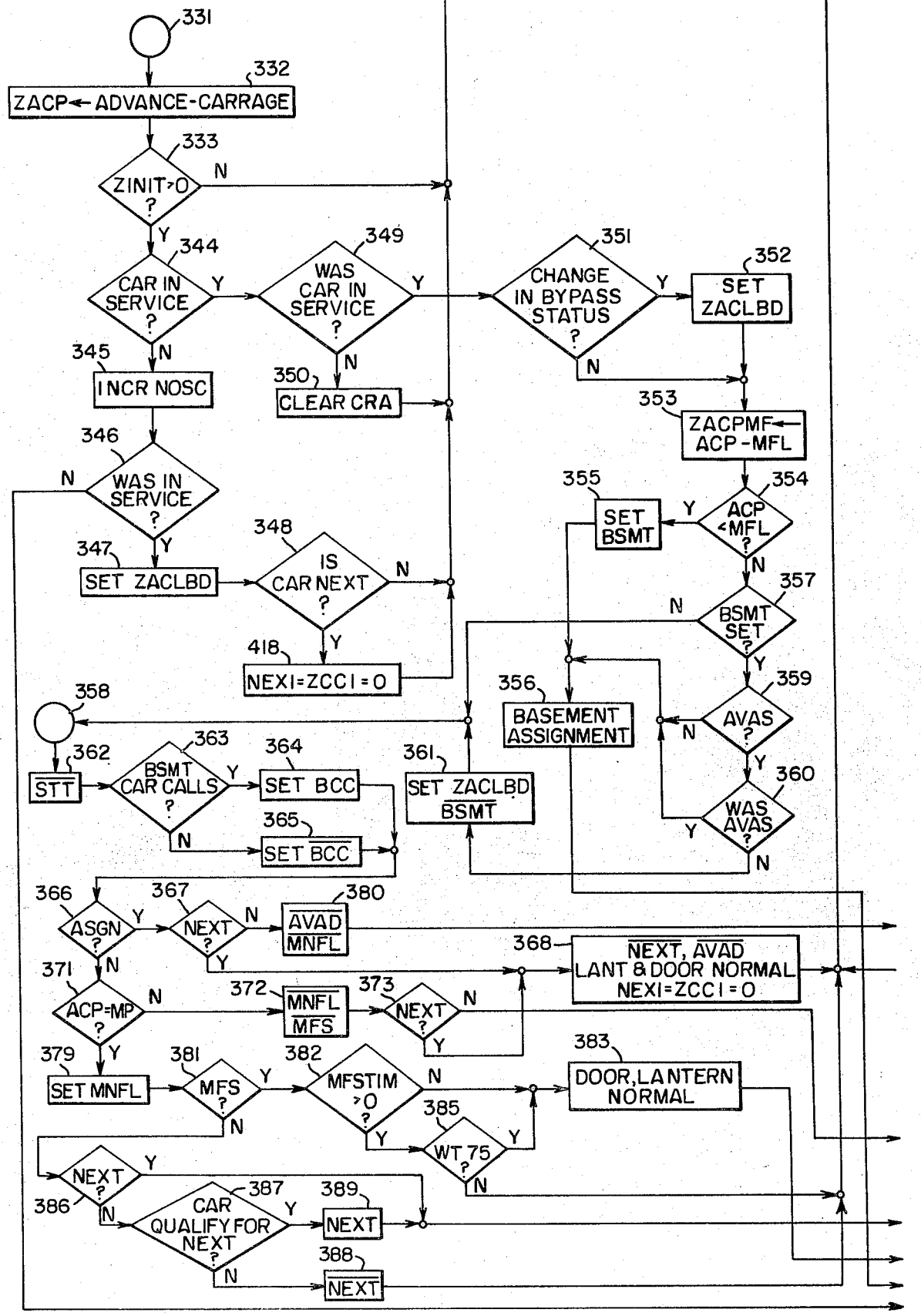
FIGS. 20A, 20B, 20C and 20D show an illustrative flow chart for determining the status of each elevator car, which flow chart may be used by the subprogram CSU shown in FIG. 19.
Figure 20B:
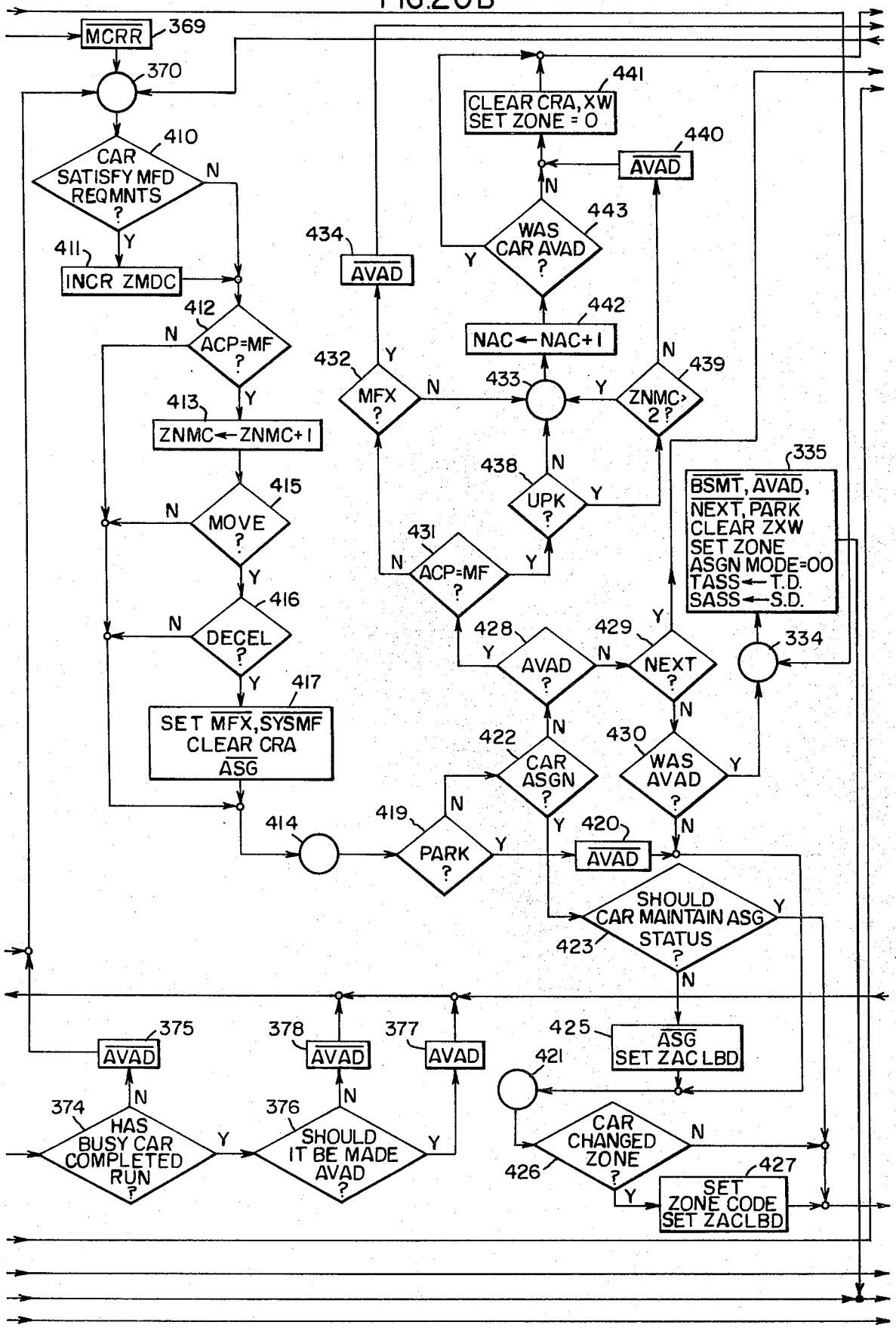
Figure 20C:
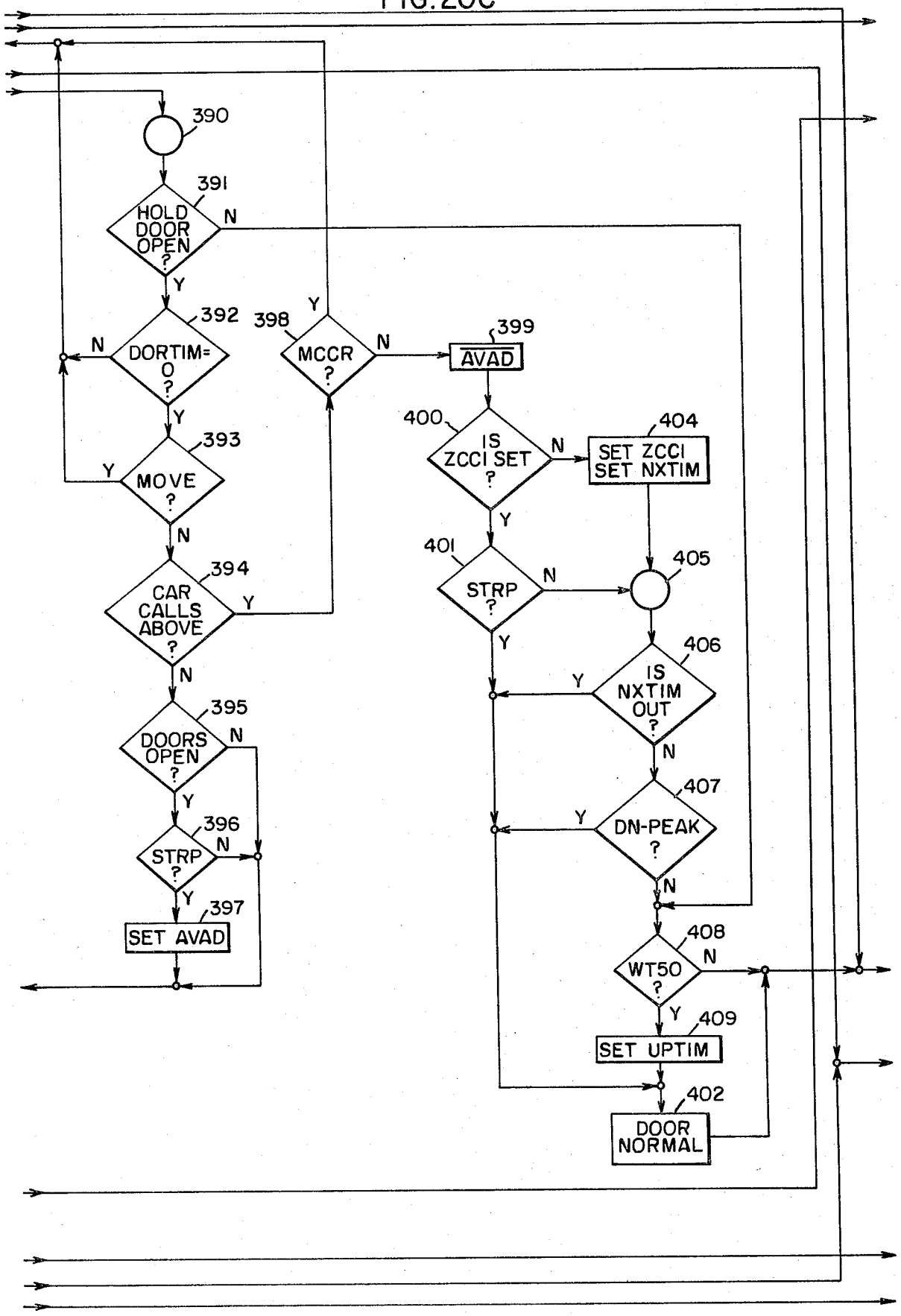

From terminal 390 in FIG. 20C, the "next" car is examined in step 391 to see if the doors should be held open. If they should, step 392 checks the door timer, and if it has not timed out the program goes to terminal 370 (FIG. 20B). If the door timer has timed out, as determined by step 392, step 393 checks to see if the car is moving. If it is, the program goes to terminal 370. If it is not moving, step 394 checks for car calls above the advanced car position. If there are no car calls above, step 395 checks to see if the car doors are open. If the car doors are not open, the program goes to terminal 370 via step 369, hereinbefore described. If they are open, step 396 determines if indicator STRP is set, indicating the safety ray beam associated with the door has been unbroken for four consecutive seconds. If indicator STRP is set, step 397 sets signal AVAD and the program goes to terminal 370 via step 369, and if STRP is not set, the program goes from step 396 to terminal 370 via step 369.

If step 394 determined that there were car calls above, the master car call reset signal MCCR is checked in step 398 to see if it is set. If it is set, indicating car calls cannot be accepted by the car, the program goes to terminal 370. If it is not set, indicating car calls may be registered, step 399 sets $\overline{\text{AVAD}}$ and checks indicator ZCCI in step 400 to see if a car call has been registered in the car. If a car call has been registered, the safety ray indicator STRP is checked in step 401. If it is set, indicating an unbroken beam for four seconds, the door is set normal in step 402, signal $\overline{\text{MCCR}}$ is set in step 403 (FIG. 20D), and the program goes to terminal 384. If step 400 finds ZCCI not set, step 404 sets ZCCI and also sets the timer NXTIM which controls the time interval before the car gets the main floor start command. The program then advances to terminal 405. If indicator STRP was not set in step 401, the program also advances to terminal 405.

From terminal 405, the program checks timer NXTIM for timing out in step 406. If it has timed out, the program goes to step 402, hereinbefore described, and if it has not timed out step 407 checks to see if the car is on down peak, and if it is, the program goes to step 402. If it is not on down peak, step 408 determines if the car weight is over 50% of its capacity. If it is over 50% of its capacity, step 409 sets the up peak timer UPTIM and the program goes to step 402. If the car weight is less than 50% of its capacity, the program goes to step 403.

Program branches which enter terminal 370 in FIG. 20B are now checked in step 410 to see if the car satisfies the requirements of meeting a main floor demand (MFD), for example, is the car AVAD and the at the main floor, or will it shortly be at the main floor because of its travel and service direction? If the car qualifies it is counted by incrementing counter ZMDC in step 411, and the program advances to step 412. If it does not meet the MFD requirements, the program proceeds directly to step 412.

Step 412 checks to see if the advanced car position is the main floor, and if so, it is counted in step 413 by incrementing ZNMC, and if not, the program advances to terminal 414. If the advanced car position is at the main floor and not moving, as checked in step 415, or moving but not decelerating, as checked in step 416, the program goes to terminal 414. If the advanced car position is at the main floor, and the car is moving and decelerating, indicating the car is just arriving at the main floor, signals $\overline{\text{MFX}}$, $\overline{\text{SYSMP}}$ and $\overline{\text{ASG}}$ are set, and the assignment register CRA of the car is cleared in step 417. The program then goes to terminal 414.

From terminal 414, the car is checked in step 419 to see if it has a PARK assignment. If it does, step 420 sets the car not available according to the dispatcher ($\overline{\text{AVAD}}$ is set), and the program proceeds to terminal 421. If the car does not have an assignment PARK, step 419 proceeds to step 422 which checks to see if the car is assigned to a demand. If it is assigned to a demand, step 423 determines if it should retain the assigned status by determining if the car has answered its first call since its assignment. If it has not answered its first call it should maintain the assigned status and the program goes to step 424 in FIG. 20D. If the car has answered the first call of its assignment, it would not retain the assigned status, and step 425 sets both $\overline{\text{ASG}}$ and ZACLBD to flag program ACL to process all the calls in the call table, as this car is now a busy car which may be given zone assignments, i.e., calls may be allocated to it.

The program then goes to terminal 421, and the car is checked for a change in zone in step 426. If it has not changed zone, the program goes to terminal 424. If it has changed zone, step 427 sets the zone code and also sets the indicator ZACLBD since this is an event requiring processing of all the calls in the call table CL the next time subprogram ACL runs. The program then goes to terminal 424.

If step 422 found the car was not assigned, step 428 checks to see if the car is AVAD. If it is not AVAD, step 429 determines if the car has been selected to be the next car to leave the main floor. If it is "next", the program goes to terminal 336, hereinbefore described.

If the car is not AVAD and not "next", step 430 checks to see if the car was AVAD the last time CSU ran. If it was not, the program goes to terminal 421, hereinbefore described. If it was AVAD on the last run, the program goes to step 335, hereinbefore described, to set the signals listed therein.

If step 428 determines that the car is AVAD, step 431 checks to see if the advanced car position is at the main floor. If it is not, step 432 determines if the car is expressing to the main floor. If it is not, the program goes to terminal 433. If it is expressing to the main floor, signal $\overline{\text{AVAD}}$ is set in step 434 and step 435 in FIG. 20D checks to see if the car is in the main zone down (zone 6). If it is not in this zone, the program goes to terminal 436. If it is in zone 6, step 437 sets the car for the main floor park assignment, with both the travel and service signals TASS and SASS set to down, and with the assignment mode 00 to reject corridor calls. The program then goes from step 437 to terminal 336, hereinbefore described.

If step 431 in FIG. 20B finds the advanced car position is at the main floor, the up peak indicator UPK is checked in step 438. If the up peak indicator is not set, the program goes to terminal 433. If the up peak indicator is set, step 439 determines if the number of cars at the main floor, excluding those with a basement assignment, is greater than two. If indicator ZNMC is greater than two, the program goes to terminal 433. If indicator ZNMC is not greater than two, step 440 sets $\overline{\text{AVAD}}$, and step 441 clears the car assignment register CRA and the extra word shown in FIG. 14, and sets the zone equal to zero, the zone for a car with no assignment. The program then proceeds to step 403 in FIG. 20D, and terminal 384, hereinbefore described.

From terminal 433 the program goes to step 442 which increases the number of available car indicator NAC by one, and then step 443 determines if this AVAD car was AVAD on the previous running of CSU. If it was not, the program advances to step 441, hereinbefore described, and if it was AVAD on the previous running, the program goes to terminal 384 in FIG. 20D via step 403, hereinbefore described.

Figure 20D:
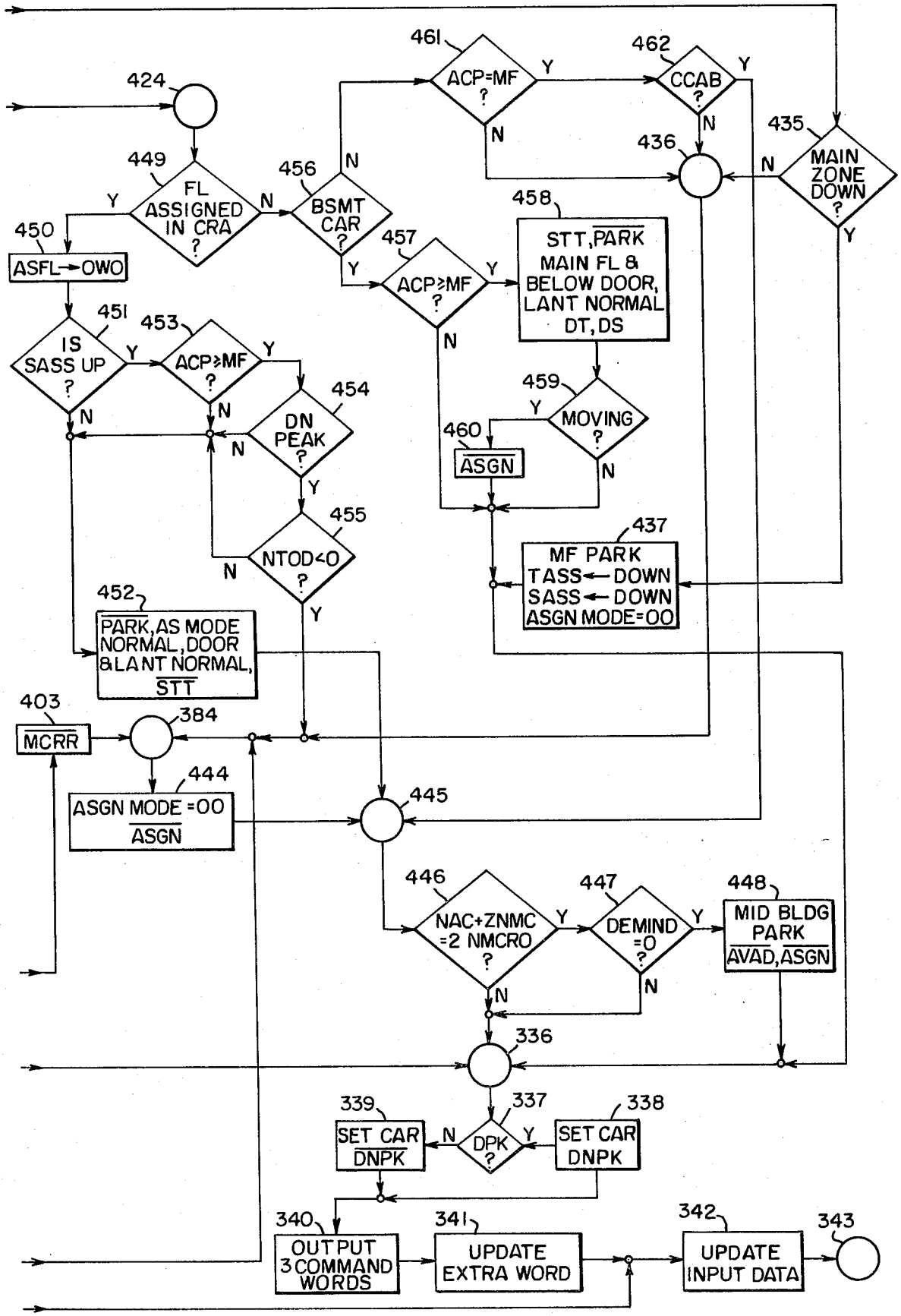

An analysis which arrives at terminal 384 in FIG. 20D sets the assignment mode 00 and sets $\overline{\text{ASGN}}$ to logic one in step 444, and advances to terminal 445. The program, from terminal 445, advances to step 446 which asks the question "are the number of available cars plus the number of cars at the main floor equal to twice the number of cars in the system?" If the answer is no, the program goes to terminal 336, hereinbefore described. If the answer is yes, step 447 determines if there are any demands in the system. If there are none, step 448 initiates a mid-building park for the car and sets $\overline{AVAD}$ and $\overline{ASGN}$, and the program returns to terminal 336. If step 447 locates a demand, the program goes to terminal 336 instead of to step 448.

A program branch arriving at terminal 424 in FIG. 20D checks in step 449 to see if the car assignment register CRA has a floor assigned therein. If it does have a floor assigned in CRA, step 450 provides the address for the floor as signal FAD0-FAD6, placing the signal in output word OW0.

Step 451 then checks to see if the service assignment SASS is up. If the answer is no, step 452 sets the assignment mode normal, the door mode normal, and the lantern mode normal, and sets $\overline{PARK}$ and $\overline{STT}$, before advancing to terminal 445.

If step 451 determines that SASS is up, step 453 determines if the advanced car position is equal to or greater than the main floor. If it is not, the program advances to step 452. If it is, step 454 checks to see if the car is on down peak, and if it is not, the program goes to step 452. If the car is on down peak, step 455 checks the number of timed out down calls. If indicator NTOD is negative, the quota for going into up call bypass is reached and the program goes to terminal 384 and to step 444 which sets the assignment mode 00, rejecting corridor calls. If NTOD is positive, the program advances to step 452 which sets the assignment mode normal, able to "see" corridor calls ahead of its service direction.

If step 449 determined that a floor was not assigned in the car assignment table CRA of the car being considered, step 456 checks to see if the car has a basement assignment or a basement car call. If it is a basement car, step 457 determines if the advanced car position of the car is at the main floor or above. If its advanced car position is below the main floor, the program goes to terminal 336 hereinbefore described. If the advanced car position is at the main floor or above, step 458 sets STT and $\overline{PARK}$, it provides a main floor and below assignment, it sets the car assignment for down travel and down service, and sets the door and hall lanterns normal. The car is checked in step 459 to see if it is moving. If it is not moving, the program goes to terminal 336. If it is moving, step 460 sets the car $\overline{ASGN}$ and then goes to terminal 336.

If step 456 determines that the car is not a basement car, step 461 checks to see if the advanced car position is at the main floor. If it is not at the main floor the program goes to terminal 436, hereinbefore described. If the advanced car position is at the main floor, step 462 checks for car calls above. If there are no car calls above, the program goes to terminal 436. If there are car calls above, the program goes to terminal 445, hereinbefore described. This completes a car status analysis which may be used for this function in program CSU.

FIG. 21

Figure 21:
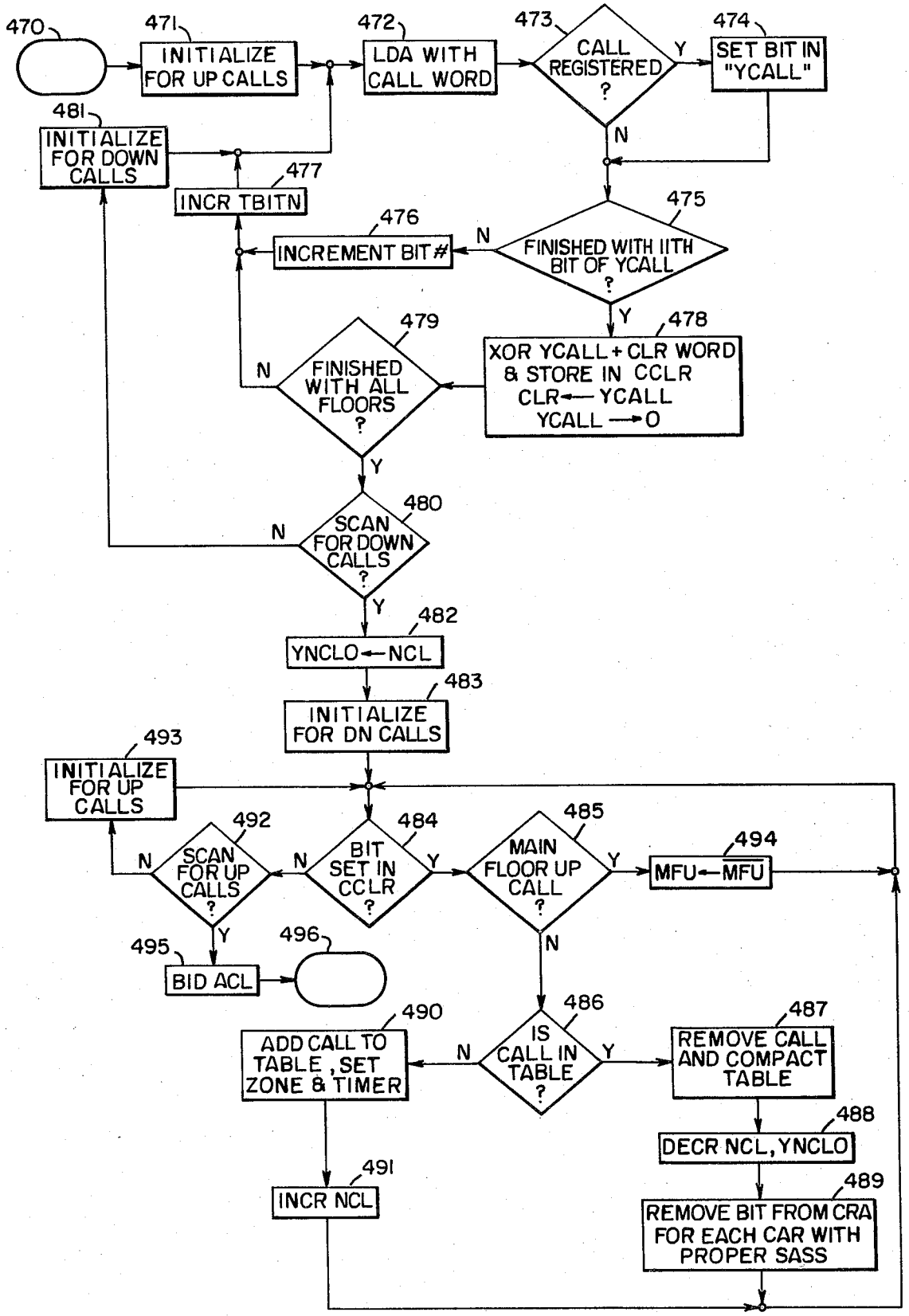
FIG. 21 is a flow chart illustrating a subprogram which may be used for the block software funtion entitled "TNC" in FIG. 4.

FIG. 21 is a flow chart of subprogram TNC, which may be used for function 164 shown in block form in FIG. 4. Subprogram TNC, which tabulates new calls, starts at terminal 470 and step 471 initializes the subprogram for scanning for up calls. The corridor call registers load their call information directly into the core during cycle state VI by direct memory access, with the core addresses being sequential in the order of the floors of the building. The up calls are located at a predetermined bit of each call word in the core, and step 472 loads the first call word into the accumulator to examine this bit. If an up call is registered, determined by step 473, a bit is set in a 12-bit word YCALL in step 474. Otherwise, step 474 is skipped. Word YCALL is a variable used to provide a call record word for comparison with the previous call record word CLR to obtain the call change record CCLR. The word YCALL then becomes the new CLR word. Steps 475, 476 and 477 go through 12 floors of the building and then, in step 478, exclusive OR's the word YCALL and the previous call record word CLR for the same floors and the result is stored in the call change record CCLR. Since YCALL is now the new CLR, word, YCALL may be set to zero to process the next group of 12 floors. Step 479 then returns to step 472 via step 477 to check the next 12 floors. When all floors of the structure have been checked, step 479 advances to step 480 which asks if down calls have been checked. Since only up calls have been checked so far, the program advances to step 481 to set the address pointer for scanning the core addresses for down calls, looking at the down call bit of the call words. The process described relative to up calls is then repeated for down calls until step 479 finds that all floors have been checked for down calls. Step 480 then advances the program to step 482.

Step 482 sets counter YNCLO to the number of calls in the call table CL, and then step 483 prepares to scan the call change record CCLR for down calls. Any bit set in CCLR indicates a change, i.e., either a cancelled call or a new call. Therefore, step 484 scans CCLR until it finds a bit which has been set. When a set bit is found, step 485 checks to see if it is an up call from the main floor. Since we are first processing down calls, it will not be a main floor up call and the program advances to step 486.

Step 486 determines if the call is in the call table. If it is, the set bit in CCLR indicates the call has been answered, and the call is removed from the call table CL, counters NCL and YNCLO are decremented, and the call is removed from any car assignment register CRA which may currently contain the call, by steps 487, 488 and 489, respectively, and the program returns to step 484 to look for another set bit in CCLR.

If step 486 determines that the call is not in the call table CL, the set bit indicates a new corridor call, and step 490 adds the call to the bottom of the call table CL, setting the zone and timer as shown in the two call words for each call in FIG. 8. Step 491 increments counter NCL, to reflect the added call, but counter YNCLO is not incremented since this call has not yet been processed by program ACL. The program then returns to step 484 to look for the next set bit in the call change record CCLR.

When no further set bit is found, or if there were none to start with, the program advances to step 492 which checks to see if the call change record CCLR has been processed for up calls. Since up calls have not yet been processed, step 493 initializes for up calls and the program returns to step 484. Step 485 checks to see if a set bit indicates a main floor up call, and if so step 494 changes the indicator MFU to the opposite condition of what it presently is. If it was a logic zero, it is set to a logic one to indicate a call. If it was a logic one it is set to logic zero to indicate the call has been answered.

The remaining portion of the up call change record CCLR is processed in the same manner described relative to down calls in the call change record. When no further set bit is found, or if none were found to begin with, step 492 advances to step 495 which places subprogram ACL into bid and exits the program at terminal 496 to return to terminal 228 of the priority executive. Since subprogram ACL is the highest priority program now bidding to run, even if CSU put ACR into bid, program ACL will now run.

FIGS. 22A-22C

Figure 22A:
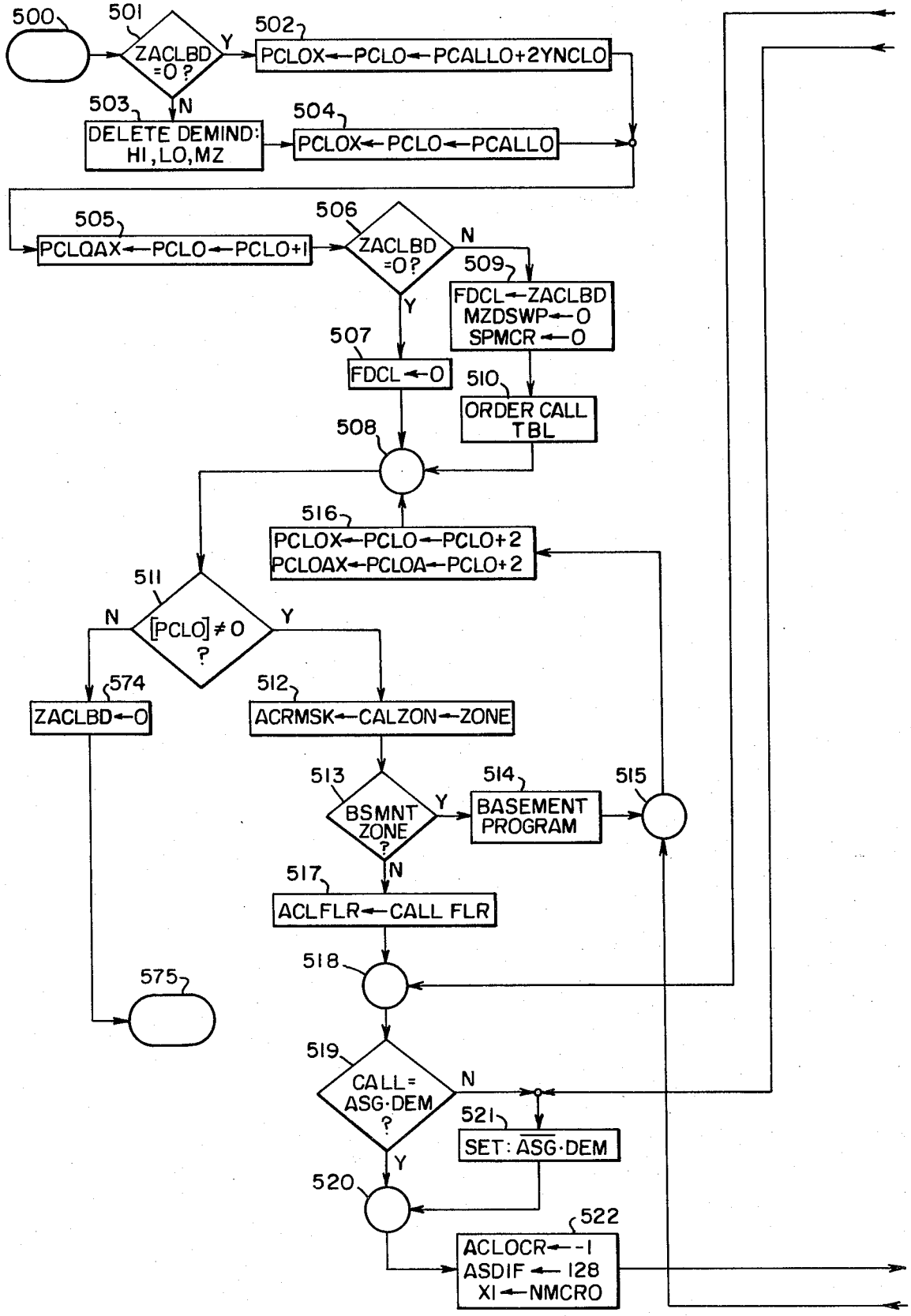
FIGS. 22A, 22B and 22C illustrate a flow chart which may be used for the block software function entitled "ACL" in FIG. 4.
Figure 22B:
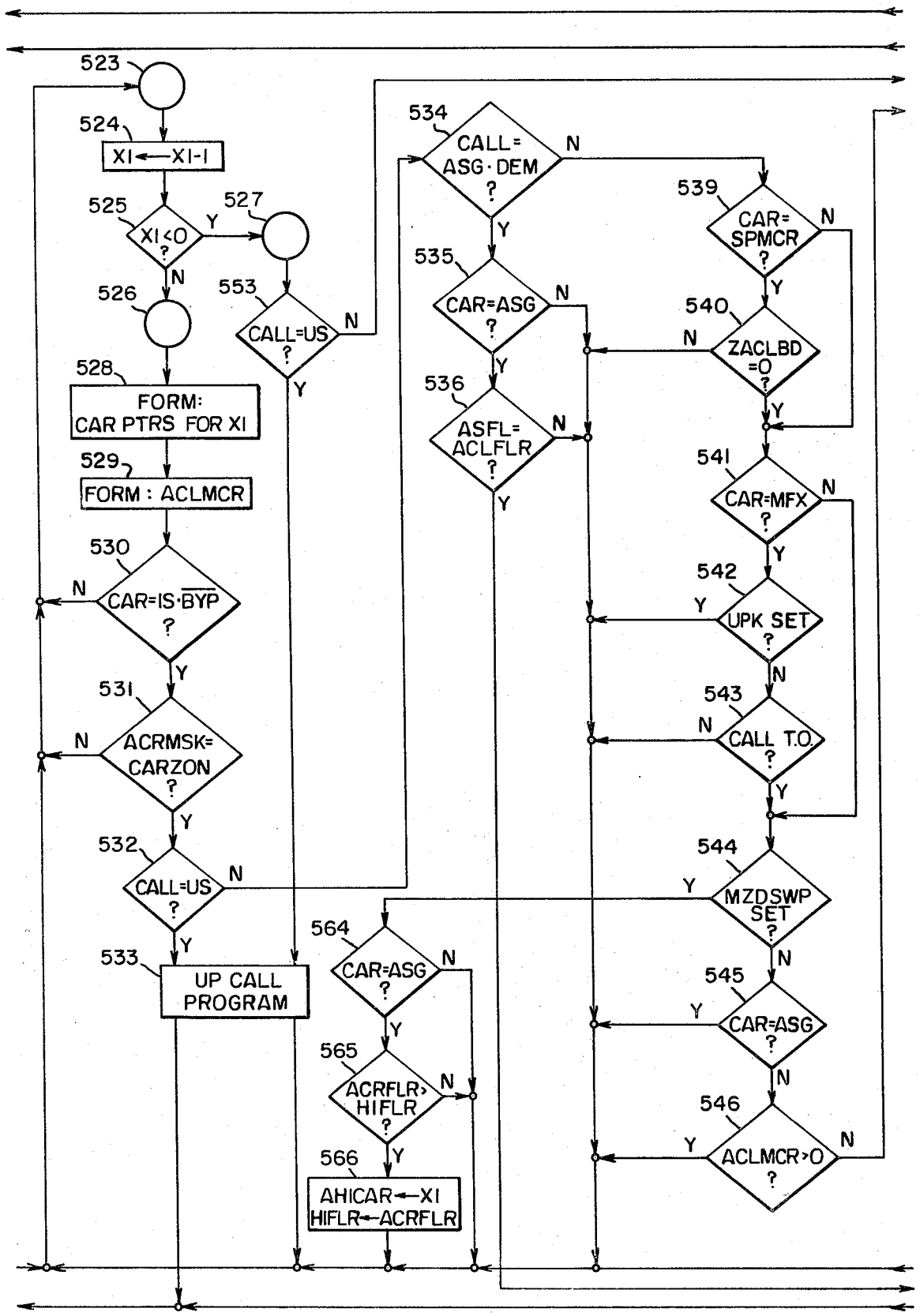
Figure 22C:
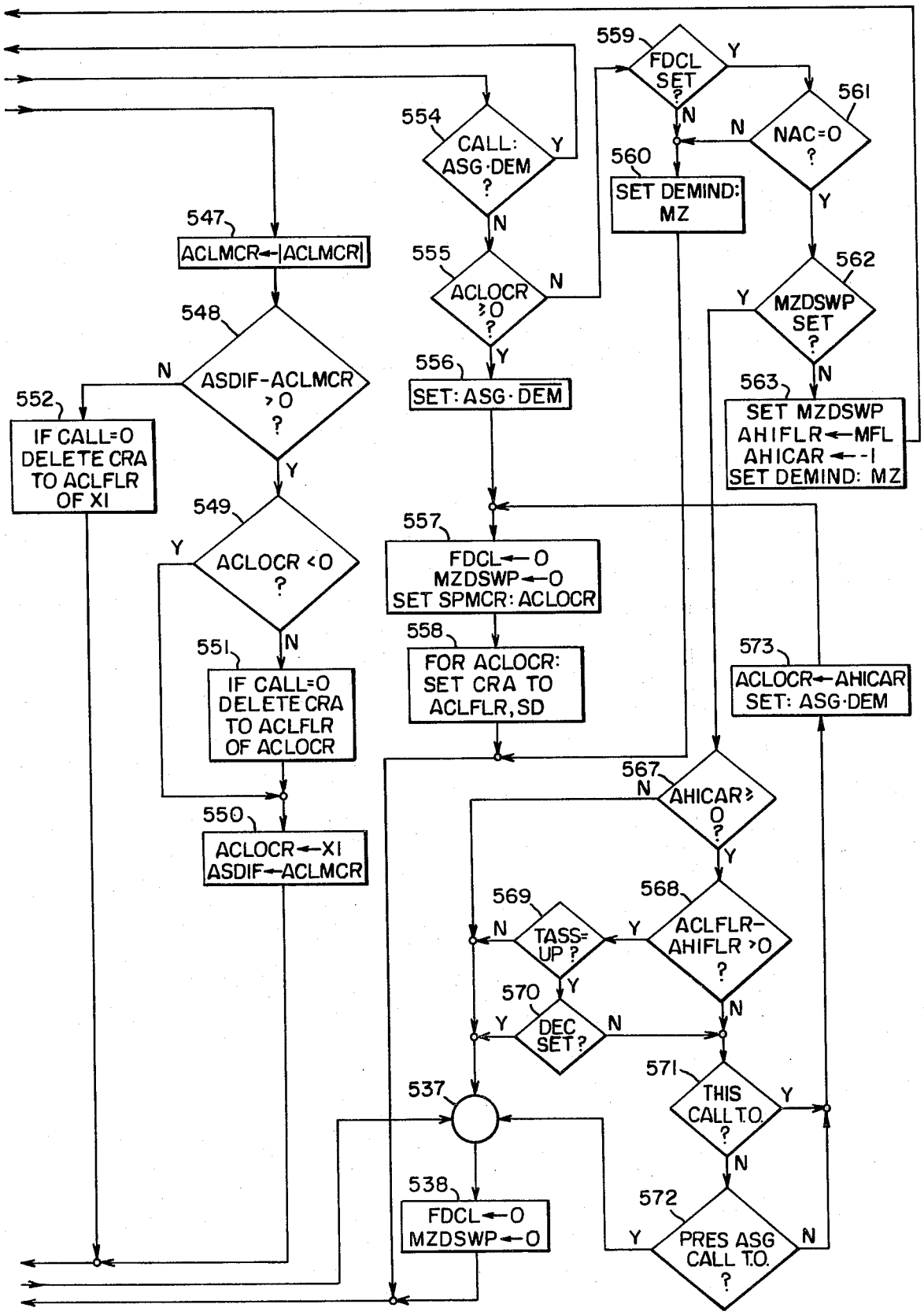

FIGS. 22A, 22B and 22C may be assembled to provide a flow chart for the strategy program ACL, shown as block 168 in FIG. 4. The function of subprogram ACL is to allocate corridor calls to suitably conditioned cars already busy with the task of serving calls for elevator service, or to create a demand signal relative to a call which cannot be so allocated. This program does not assign available cars to demand calls, as that function is performed by subprogram ACR when a demand exists, determined by ACL, and there is an available car which can be assigned to this demand, determined by CSU, which then puts ACR into bid.

Subprogram ACL starts at terminal 500 and then immediately checks flag ZACLBD in step 501 to see if CSU found an event which indicates that the whole call table CL should be processed, as opposed to only processing new calls which were added to the bottom of the processed calls in the call table CL by subprogram TNC. If flag ZACLBD is not set, step 502 sets the address pointer to the first new call. Since each call has two words in the call table, the address of the first new call is the address PCALLO of the first call plus twice the number of calls in the call table (2YNCLO).

If ZACLBD is set, all demands are reset in step 503 and step 504 sets the pointer to the first call in the call table CL. Steps 502 and 504 both advance to step 505 which sets the address of the second word of the first call to be considered.

Step 506 again checks indicator ZACLBD, and if it is not set, step 507 sets indicator FDCL to zero, as only new calls will be processed, which omits the portion of the program relative to highest down call strategy. The program then advances to terminal 508.

If step 506 finds ZACLBD set, indicating all calls will be processed, the highest down call strategy will be used, and step 509 sets FDCL to logic one, it sets indicator MZDSWP to zero, which indicator is also used in the highest down call strategy, and it sets indicator SPMCR to zero, used to indicate when a zone 6 unassigned ($\overline{ASG}$) car has been given a down corridor call.

Step 509 then advances to step 510 which orders the call table CL, using any of the well known sorting techniques, to place the highest call in the building at the top of the list, and the rest of the calls in order as they appear in the building when proceeding downwardly from the highest call registered. The program then advances to terminal 508.

From terminal 508, the program goes to step 511 which examines the contents of the address of the first word PCLO of the call, which may be the first call in the call table, or the first new call, depending upon whether ZACLBD is set. If the contents of address PCLO is not zero, there is a call at this address and step 512 sets the zone mask ACRMSK for car selection, and CALZON to the zone of the call, taken from bits 0, 1 and 2 of the first call word.

Step 513 checks CALZON to see if the call is for the basement zone (zone 1 as determined from FIG. 15). If it is for the basement zone, step 514 runs the basement program and then advances to terminal 515. When a call has been processed, the program always returns to terminal 515 to start the selection of the next call, with the addresses of the two words of the next call being established in step 516. The program then returns to terminal 508 to examine the contents of the address of the first word of this next call. The basement program, for example, sets predetermined requirements for a basement car, and finding such a car would set the signal BSMT for this car to a logic one. If such a car is not found, it would create a demand for the basement by setting bit number one in DEMIND associated with a basement demand B. In either event, the program would return to terminal 515 as described.

If step 513 determines that the call zone (CALZON) is not the basement zone, step 517 sets the variable ACLFLR equal to the call floor and advances to terminal 518.

The program then advances from terminal 518 to step 519 which checks bits 0 and 1 of the second call word to see if the call is a demand, and to see if a car has been assigned to this demand. If the call is an assigned-demand call, the program advances to terminal 520. If the call is any other combination besides an assigned-demand call, step 521 arbitrarily sets the call as a demand call, but unassigned ($\overline{ASG}$), regardless of what the combination actually is. The program then advances to terminal 520.

Step 522 arbitrarily sets the variable ACLOCR to minus one. This variable will later be set to the car number of the closest suitable car found to the call floor, and will be changed to the car number of a closer suitable car, as other cars are considered and closer cars found. Step 522 arbitrarily sets the variable ASDIF to 128. ASDIF will later be set to the call floor minus the advanced car position of the closest suitable car found, and will be changed as required when closer suitable cars are found. Step 522 also sets the variable X1 to the number of cars in the elevator system. The program then advances to terminal 523 (FIG. 22B), which is the terminal the program returns to each time it wishes to consider another car relative to the specific call being considered.

Step 524 then sets X1 to X1 minus one, since the highest number assigned to a car is one less than the maximum number of cars in the elevator system, when assigning numbers to cars starting with zero.

Step 525 is used to detect when all of the cars have been considered relative to a specific call, advancing to terminal 526 when it is considering a car, and to terminal 527 when there are no further cars to consider.

If a car is being considered, terminal 526 advances to step 528 to provide the address for obtaining information relative to the car being considered, and step 529 sets the variable ACLMCR equal to the call floor minus the advanced car position of the car being checked. Step 530 checks to see is the car is both in service and not bypassing corridor calls. If the car is not in service, or if it is in service but it is bypassing corridor calls, the program returns to terminal 523 to consider the next car, as this car is not suitable for any call regardless of its location in the building or its service direction.

If the car passes the "in service" and "not bypassing" test of step 530, it is then checked in step 531 to see if mask ACRMSK for car selection exposes the zone of the car (CARZON). If the car does not pass this test, i.e., it does not have the same zone as the call being considered, the program returns to terminal 523 to consider the next car. It will be noted that only busy cars can be considered, an an available car without an assignment is given the code of zero (see FIG. 15). The zone of a busy car is the zone of its advanced car position, while the zone of an assigned car, a car which has not started to decelerate to answer the first call after being assigned to a demand, has the zone of the call it is assigned to answer.

If the car passes the test of step 531, we already know that it has the proper service direction for the call, because the zone also identifies the service direction. The program then advances to step 532 which checks the service direction of the call. If the call is for up service, step 533 runs the up call program and then returns to terminal 523 to consider another car. The up call program is not shown in detail, as it may be very similar to the down call program, if desired, or as in the usual case, it may not be as complicated as the down call strategy. For example, the up call program may follow the strategy set forth in U.S. Pat. Nos. 3,292,736 and 3,256,958, both of which are assigned to the same assignee as the present application. In general, if the ACLMCR is equal to or greater than zero, the advanced car position is at or below the floor of the call, and the car is therefore suitably conditioned for the up call. It is then just a matter of storing the car number and position of the closest suitably conditioned car to the call, and updating it as a closer suitable car is found. After the up call program in step 533 processes a car relative to a call, it returns to terminal 523 to process the next car.

If the call being considered in step 532 is for down service, the program advances to step 534 which tests the call to see if the call is a demand call and whether a car has been assigned thereto. If it is a demand call and a car has been assigned to the demand, it will be referred to as an assigned-demand call. If it is an assigned-demand call, the car is checked in step 535 to see if this car is an assigned car, i.e., a car assigned to a demand which has not yet started to decelerate to answer the first call of the demand assignment. If the car is an assigned car, step 536 checks to see if the floor the car is assigned to is the same as the floor of the call presently being considered. If it is, then the call is allowed to remain with this car, since the car is already in the process of answering the call, and the program advances to terminal 537 and to step 538 which sets indicators FDCL and MZDSWP to zero, since if this call was the highest down call, the special highest down call strategy need not be considered. Since no further cars need be considered relative to this call, step 538 returns to terminal 515 to select the next call.

If step 534 determines that the call is an assigned-demand call but step 535 finds the car to be unassigned ($\overline{ASG}$) or if the car is assigned and step 536 finds that the assigned floor is not the same as the call floor, then the program returns to terminal 523 to consider the next car.

If step 534 finds that this down call is not an assigned-demand call, the program advances to step 539 which checks to see if the car has already been given a zone 6 down call. If a car is given a zone 6 down call, an indicator SPMCR is set, and if the whole call table is being processed, an SPMCR car is not considered for another down call. Step 540 checks to see if the whole call table is being processed by checking indicator ZACLBD. If the car is a SPMCR car, i.e., its indicator SPMCR is set, and the whole call table is being processed, this car is no longer considered for the call being processed and the program returns to terminal 523 to check another car. The strategy is to get as many cars working on zone 6 down calls as possible, in order to exhaust busy cars in zone 6 and create a demand for an available car, or cars to be assigned to zone 6 when the number of zone 6 down calls exceeds the number of busy cars serving zone 6.

If the car is not a SPMCR car, or if it is and only new calls are being considered, the program advances to step 541 which checks to see if the car is expressing to the main floor. If the car is expressing to the main floor, step 542 determines if the up peak indicator UPK is set. If it is, this car is no longer considered for the call and the program advances to terminal 523 to consider another car. If the car is expressing to the main floor but the up peak indicator is not set, step 543 determines if the call being processed is timed out. If it is not timed out, this car is no longer considered for the call and the program returns to terminal 523.

If the car is not expressing to the main floor, or if it is expressing to the main floor and the up peak indicator is not set and the call is timed out, the program advances to step 544 to check the condition of indicator MZDSWP. This indicator will only be set when the highest down call cannot be allocated according to a first set of conditions, and provides the opportunity to try to allocate the highest down call according to a second set of conditions before leaving subprogram ACL. Since we haven't determined that this call cannot be allocated at this point, indicator MZDSWP will not have been set, even if this is the highest down call registered. Therefore, the program advances to step 545.

Step 545 determines if the car has been assigned to a demand call by subprogram ACR. If it has been so assigned, this car is no longer considered for this call and the program returns to terminal 523. A car retains its assigned status once it is given an assignment by program ACR until it starts to decelerate for the first call of the demand assignment, at which time it becomes a busy car to which program ACL may allocate corridor calls.

If the car is not in the assigned status, step 546 checks to see if ACLMCR, formed in step 529, is greater than zero. If it is greater than zero, the advanced car position is on the wrong side of the call, i.e., below this down call and the program returns to terminal 523 to consider another car. If the call floor minus the advanced car position is not greater than zero, i.e., zero or negative, then the advanced position of the car is either at or above the floor of the call, and we have not found a suitable car for the call.

When a suitable call is found for a call, it is now checked to see if it is the most suitable car found so far, or if a more suitable car was found during checking a higher numbered car relative to this call. The basis for comparing suitability to find the most suitable car, is which car has an advanced car position closer to the call floor. This function is performed by first obtaining the absolute value of ACLMCR without regard to its sign, which is performed in step 547 (FIG. 22C), and then checking in step 548 to see if ASDIF minus ACLMCR is greater than zero. ASDIF is the difference between the call floor and the advanced car position of the closest car to the call floor found so far. If this is the first suitable car found, ASDIF will still be 128, since it was arbitrarily set to this value in step 522. In this instance, ASDIF minus ACLMCR will be greater than zero, and the program advances to step 549. If should be noted that if a suitable car was previously found and the present suitable car is closer to the call floor that ASDIF minus ACLMCR will also be greater than zero, and in this instance the program will also advance to step 549. Thus, the program advances to step 549 when the car being considered is the most suitable car found so far.

Step 549 then determines if this "most suitable car so far" is the first suitable car found, or a more suitable car than one previously found to be suitable. It does this by checking ACLOCR relative to zero. If it is negative, as it was arbitrarily set in step 522, this is the first car found to be suitable and the program advances to step 550 which sets ACLOCR to the car number of the car presently being considered, and sets ASDIF to that of ACLMCR. Thus, a future suitable car will be compared with this car to determine which is more suitable. The program then goes to terminal 523 to consider another car relative to this call. If a suitable car was previously found but the present car is more suitable, ACLOCR will not be negative, so step 549 will go to step 551.

Step 551 checks to see if the car which was found to be less suitable has a car call by checking the signal CALL. If it does not have a car call and the floor call now being considered was allocated to the car on a previous running of program ACL, the allocation of this floor call to the less suitable car is removed by removing the call from its assignment table CRA. The strategy is to unclutter the call registers of the cars by removing call allocations they will not answer, expediting their return to the availability status, which allows them to be assigned to demands. However, if the car has a car call, it will not be going back to the available status until it serves the car call, and since the car is suitable for the floor call being processed, it is allowed to retain the floor call allocation in the event the more suitable car is delayed in answering the call for some reason.

Assuming that a suitable car was already found for the call being processed during the present running of program ACL, or during a previous running thereof, and that step 548 determines that the previous suitable car is more suitable than the car now being considered. In this instance, step 548 will advance to step 552. If this call had been allocated to the car now being considered during a previous running of subprogram ACL, step 552 removes this call from its assignment table CRA if the car has no car calls. The reason behind this strategy is the same as explained for step 551. The program then returns to terminal 523 to consider another car. The up call program in step 533 may use steps 547 through 552 to find the most suitable car for an up call in the same manner as just described for down calls.

Once all the cars have been considered relative to a call, the number of the most suitable car found will appear in ACLOCR, and the difference between the advanced car position of this car and the call floor will appear in ASDIF.

When all cars have been considered relative to a call, step 525 determines this when X1 becomes negative, and the program advances to terminal 527 and to step 553. Step 553 checks the service direction of the corridor call presently being considered. If the call is for up service, the program advances to the up call program in step 533. This part of the up call program checks to see if a suitable car was found by checking to see if ACLOCR is still a negative 1. If it is, a demand will be registered for the zone of the call and a corresponding bit set in DEMIND. If ACLOCR is not negative, a suitable car was found and its assignment table CRA is set to the call floor.

If step 553 determines that the call is for down service, the program advances to step 554 (FIG. 22C) where the call is checked to see if is an assigned-demand call. If the answer is yes, it is immediately known that no car was found for this call as when step 536 found a car assigned to the floor of an assigned-demand call the program advanced to step 538 and to terminal 515 to consider the next call. Thus, a car was not found assigned to the floor of an assigned-demand call when an assigned-demand call reaches step 554. If the call is an assigned-demand call, step 554 returns the program to step 521 which arbitrarily sets the call as a demand call but unassigned. All cars are looked at again relative to this call, but this time in an attempt to find a suitable car, rather than a car assigned to the floor of the call. Thus, this time the program will branch from step 534 to step 539 and follow the precedure hereinbefore described for $\overline{ASG}$ and DEM calls. When all cars have been considered, the program will return to step 554.

If step 554 finds that the call is not an assigned-demand cell, step 555 checks to see if a suitable car was found for the call by checking ACLOCR. If ACLOCR is not negative, a suitable car was found and the call is set ASG and $\overline{DEM}$ by step 556 to indicate that it is a call allocated to a car by subprogram ACL, as opposed to a demand call to which a car was assigned by subprogram ACR.

Since a suitable car was found, step 557 sets indicator FDCL and MZDSWP to a logic zero, since the highest down call strategy will not now apply to this running of program ACL. The bit of SPMCR corresponding to the most suitable car found (ACLOCR) is set, to prevent this car from being allocated another zone 6 down call when the whole call table is being processed, as hereinbefore described relative to steps 539 and 540.

Step 558 puts the floor of the call into the assignment register CRA of the most suitable car found (ACLOCR), and the program returns to terminal 515 to consider the next call in the call table CL. The up call program 533 may use the same step 558 when it finds a suitable car for an up call.

If step 555 finds ACLOCR still negative, a suitable car was not found for the call and the program advances to step 559 to see if this call is the highest down call by checking indicator FDCL. If the whole call table is being processed, and this call is the highest down call registered, FDCL is set to logic one by step 509. If indicator FDCL is not set, step 560 creates a demand for the main zone down (Zone 6), which appears in DEMIND (bit 6), and the program goes to terminal 515 to consider the next call.

If indicator FDCL is set, special treatment is given this highest down call by changing the requirements for a suitable car, and the cars are checked again relative to the call. However, this is not due unconditionally. Step 561 first checks to see if there are any available cars to assign to a demand. If there is an available car, the program allows the unassigned highest down call to create a demand by branching the program to step 560 and then returning to terminal 515 to take the next call. The strategy here is to prevent two elevator cars from being made to traverse substantially the full length of the building unnecessarily. In the prior art the assignment to answer the highest down call persists in that if while an assigned car is moving to answer the highest down call, another down call is registered which is still higher, the car goes to this new higher call and the original call becomes a demand which is given to the next available car. In this instance, an available car which is close to the last registered highest down call will not be assigned to this down call, as the assignment of the already assigned car will be changed to this higher down call. The available car which is close to this last registered highest down call may then be assigned to the down call originally assigned to the first car. Thus it will be seen that both of these cars may travel unnecessarily long distances to reach their assigned floors. The present strategy assigns the highest down call to the closest car, and then when a new higher down call appears, the system is interrogated as to there being any more available cars. If there are no available cars, this new higher down call is given to the assigned car traveling to the call which was originally the highest down call. If there is an available car, the assignment is not changed. The program produces another demand, assigning this call to the closest available car, while still maintaining the priority of the highest down call.

When there are no available cars, as determined by step 561, the program advances to step 562 which checks to see if the indicator MZDSWP is set. Step 509 reset MZDSWP by setting it to zero, and thus MZDSWP is not set at this point. The program then advances to step 563 which sets MZDSWP by setting it to a logic one. Step 563 also sets AHIFLR arbitrarily to the main floor, with AHIFLR being subsequently set to the floor of the advanced car position of the highest car found. AHICAR is also arbitrarily set to minus one, with AHICAR being subsequently set to the car number of the highest car found. A demand for the main zone down (zone 6) is also registered by step 563, which appears in DEMIND.

The program now returns to terminal 518 to process this unassigned highest down call for a second time. This down call is processed according to an unassigned demand call, as hereinbefore described, until reaching step 544. If a car passes all of the tests up to step 544, step 544 now finds that MZDSWP is set, having been set by step 563 to signify the second processing of an unassigned highest down call. The program now branches from step 544 to step 564 which picks out the cars which are assigned to demand calls. It will be remembered that the first processing of this call eliminated such cars from consideration in step 545, considering only unassigned cars. On this second processing, only cars assigned to a demand call are considered. If step 564 finds the car unassigned it advances the program to terminal 523 to look at the next car.

If the car is assigned, the advanced car position of this car (ACRFLR) is checked in step 565 to see if it is the highest assigned car considered so far (HIFLR). If this is the first assigned car found in this reprocessing of the highest down floor call, and it is above the main floor, it will be the highest car since HIFLR was arbitrarily set to the main floor. If ACRFLR is not greater than HIFLR the program goes to terminal 523 to consider the next car. If this is the highest car found so far AHICAR is set to the car number of the car presently being considered, and HIFLR is set to the floor of the advanced car position of this car in step 566. When all cars have been considered AHICAR will thus contain the car number of the highest assigned car in the building and HIFLR will contain the floor of the advanced car position of this car.

When all cars have been considered relative to this call, the program will follow step 553, 554, 555, 559 and 561 to step 562. Step 562 will now find MZDSWP set since it was set by step 563 to mark the second processing of the highest down call. The program then goes to step 567 which checks to see if a car was found during the second processing of the highest down call. If no car was found, AHICAR will still be minus one due to step 563, and the program advances to step 538 to reset FDCL and MZDSWP, and then it will go to terminal 515 to take the next call.

If a car was found AHICAR will be equal to the number of the car, and the program advances to step 568. Step 568 determines the location of the car relative to the call floor by subtracting AHIFLR from ACLFLR. If the difference is greater than zero, the floor of the advanced car position of the car is below the highest down call. If the advanced car position is below the call floor, step 569 checks the travel assignment TASS. If the travel assignment is down, the program goes to the next call via step 538. If the travel assignment is up, step 570 checks to see if the car has started to decelerate. If it has, the program goes to the next call via step 538. If it hasn't, it is not too late to change the car's assignment, and the program advances to step 571, which is where the program goes when step 568 determines that the advanced car position of the car is above the call floor. Thus, an assigned car traveling upwardly for a down floor call will have its assignment changed to the higher registered down floor call, and since only one car is assigned to each down floor call in zone 6, the previously assigned call will become a demand the next time this call is processed by subprogram ACL, if the call cannot be allocated to a busy car.

Step 571 checks to see if the call presently being considered, i.e., the highest down call registered, is timed out. If it is not timed out, step 572 determines if the call the car is presently assigned to answer is timed out. If it is the program returns to terminal 515 via step 538 to consider the next call. If the call presently being considered is timed out, or if it is not timed out and the call the car is assigned to is not timed out, the program advances to step 573 which sets the car number of the closest suitable car (ACLOCR) to the car number of AHICAR set in step 566. The call is also set assigned and a demand by step 573 since it is being given to an assigned car. The program then goes to step 557 to reset FDCL and MZDSWP and to set SPMCR, and step 558 then puts the floor of this highest down call into the assignment register CRA of this car (ACLOCR). The original down call assigned to this car will not have a car found to be assigned to its floor during the next running of program ACL and an attempt will then be made to allocate the call to a busy car or a demand will be created for it to which an available car will be assigned.

When all of the calls to be processed have been completed, step 511 finds the contents of PCLO now equal to zero, and the program then sets ZACLBD to zero in step 574, and exits the program via terminal 575 to return to the priority executive. Program ACL does not have to put subprogram CHECK into bid since this function is accomplished by step 232 of the priority executive, as hereinbefore described.

FIGS. 23A & 23B

Figure 23A:
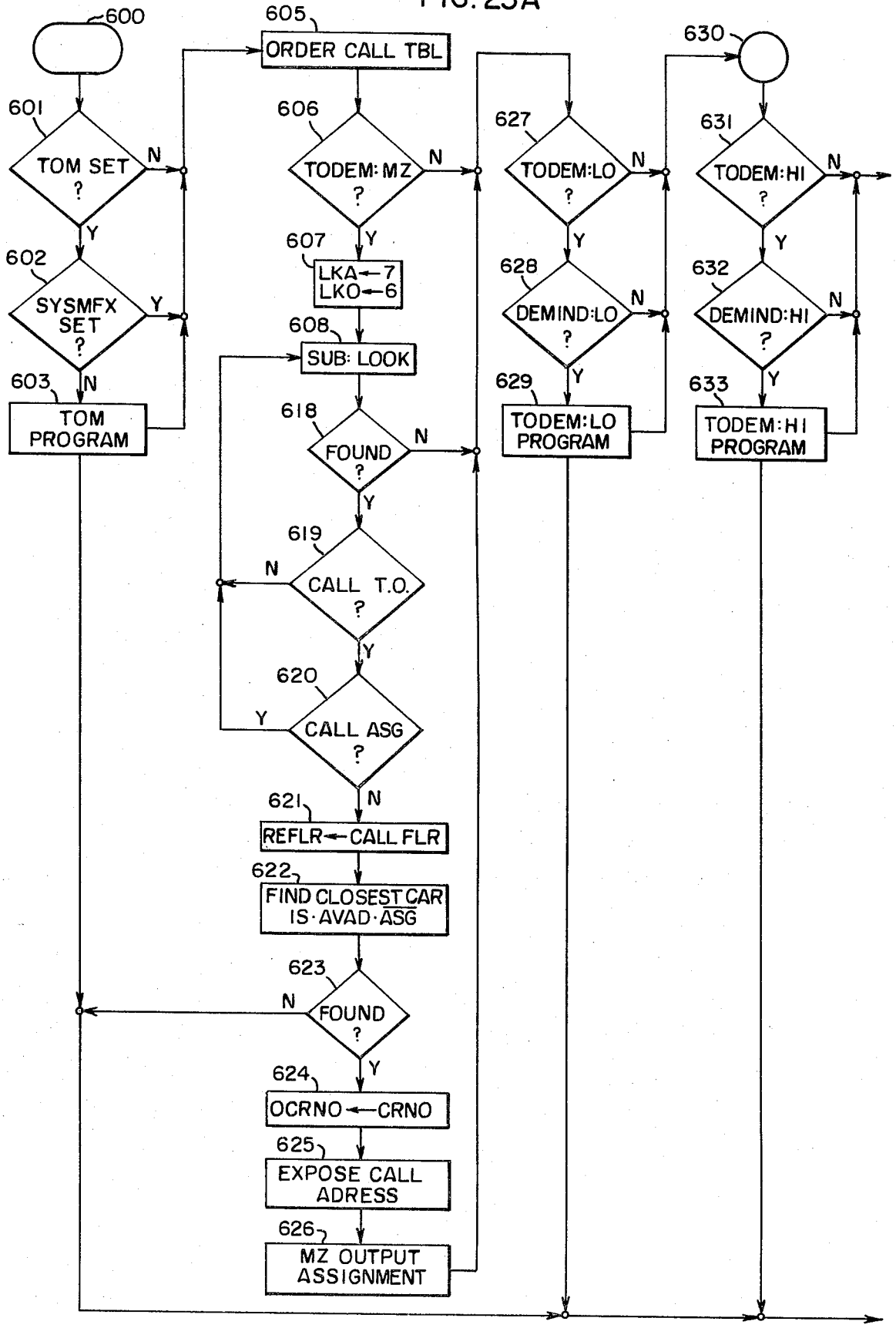
FIGS. 23A and 23B illustrate a flow chart which may be used for the block software function entitled "ACR" in FIG. 4.
Figures 23B, 24:
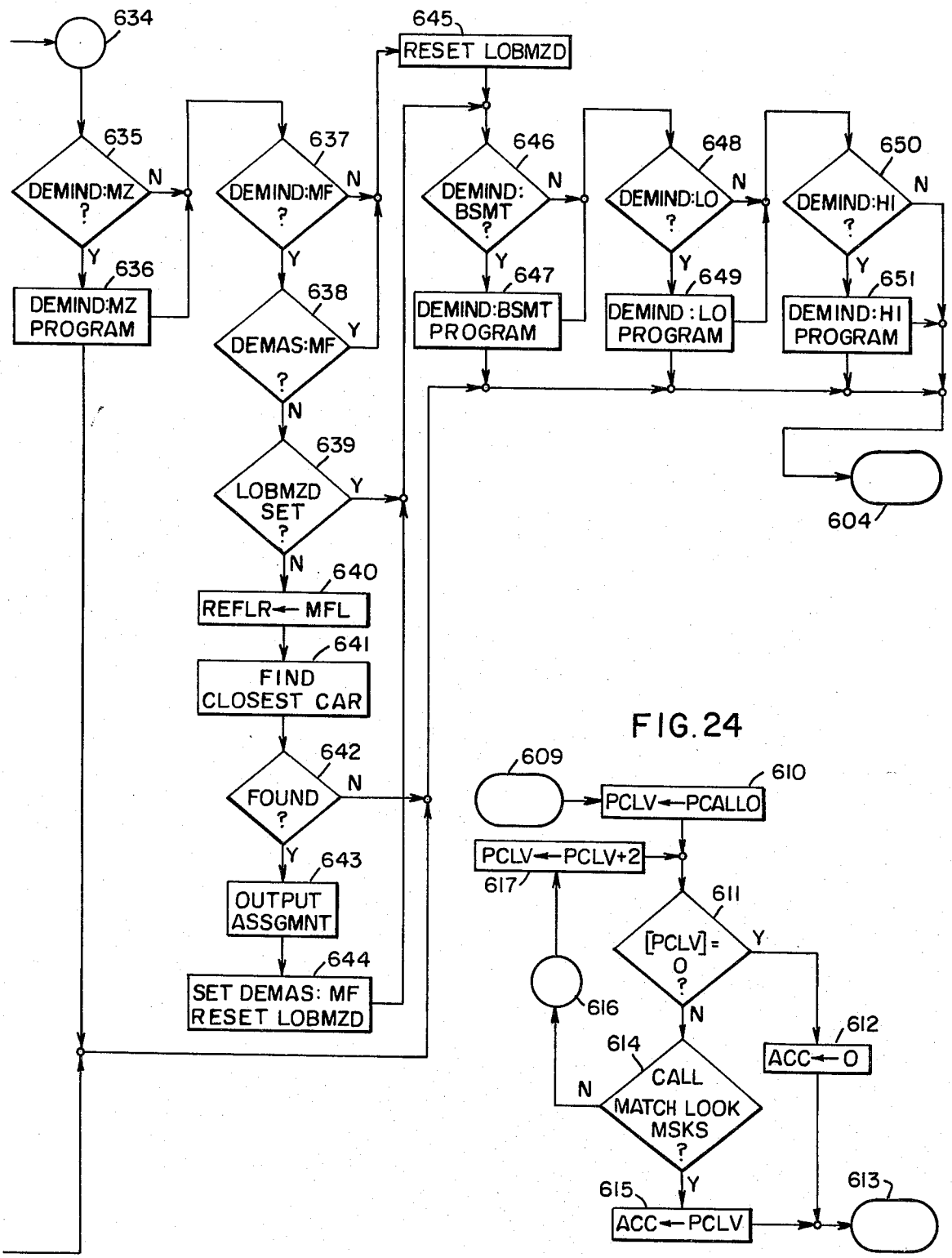
FIG. 24 is a flow chart for a subroutine "LOOK" which may be used in the software function; and Program Listing One at the end of the specification illustrates a suitable program in accordance with the flow charts shown in the Figures.

FIGS. 23A and 23B may be assembled to provide a flow chart of subprogram ACR, which may be used for the function 172 shown in FIG. 4. The function of subprogram ACR is to assign available cars, i.e., those not already busy serving a call for elevator service, to demands created by subprogram ACL when subprogram ACL is unable to allocate a floor call to a properly conditioned busy car. As described in the second incorporated application, the floor selector of an elevator car provides a signal AVAS to the programmable system processor when the car is in service but not presently serving a call for elevator service. Signal AVAS is provided when an in service car is not running or decelerating and its doors are closed. The system processor then makes its own decision concerning availability, providing a signal AVAD when the car is considered available by the system processor for demand assignments.

As hereinbefore explained, program ACR only runs when a demand is created by subprogram ACL, and CSU determines that there is an available car which can be assigned to the demand. Subprogram CSU puts ACR into bid, but it will not run until programs TNC and ACL have run, since ACR has a lower priority than either of these subprograms. Thus, when subprogram ACR is bid by subprogram CSU, it breaks the program out of its first loop or cycle and directs it to the second loop or cycle which includes ACR.

Subprogram ACR successively checks the different types of system demands, in a predetermined order of priority. Since when a demand is found, the program for finding an available car for the demand, is in general, similar for each demand, only the timed out demand for zone 6, i.e., main zone down, indicated in the timed out demand word TODEM, and the demand for the main floor, indicated in the demand word DEMIND, will be described in detail.

More specifically, subprogram ACR starts at terminal 600 and step 601 checks indicator TOM, which when set indicates the main floor timer MFTIM has timed out. If TOM is set, step 602 then checks SYSMFX, which when set, indicates there is a car expressing to the main floor. If indicator TOM is set and indicator SYSMFX is not set, the program advances to step 603 which attempts to find a car for the main floor. If a car cannot be found, the program may exit at terminal 604 (FIG. 23B) and return to the priority executive since it is unlikely that a car could be located for any other type of demand which might be registered. Or, the program may be arranged to check certain other types of demands and attempt to find a car if it finds one of these demands registered. The complete program loop is so fast that there will usually only be one type of demand registered for any specific running of ACR. Thus, as a practical manner, when ACR finds a demand and it cannot assign a car to that demand, the program may immediately return to the priority executive.

If indicator TOM is not set, or if set and indicator SYSMFX is set, or if step 603 finds a car, the program advances to step 605 which orders the call table CL in the same manner described relative to step 510 in subprogram ACL Step 606 checks TODEM for a timed out demand in zone 6, i.e., a timed out main zone down call. If bit 6 of TODEM, representing a timed out main zone down demand MZD, is set, step 607 sets bit selection masks LKA and LKO equal to binary 7 and binary 6, respectively, which are than and'end and exclusive or'ed with a call word in subroutine LOOK in step 608 to find a call of a certain type, and then see if the zone of the call matches the zone of the demand, i.e., zone 6 in this instance.

FIG. 24 is a flow chart of subroutine LOOK which may be used for step 608, which subroutine is entered at terminal 609. Step 610 sets the variable PCLV equal to the address of the first word of the call table (PCALLO). Since step 605 ordered the call table, the first word of the call table will be the highest call in the building, and may be an up or down call. Step 611 checks the contents of PCLV. If the contents is equal to zero, indicating no calls in the call table, step 612 then sets the accumulator equal to zero and returns to program ACR via terminal 613.

If the contents of PCLV is not zero, step 614 checks to see if the call in PCLV matches the look masks. Since LKA was set to binary 7 in step 607, and'ing a binary 7 with the call word exposes bits 0, 1 and 2 of the first call word, which bits are used to identify the zone. LKO, set to binary 6, exclusive or's binary 6 with the zone of the call. If they match, the call is a main zone down call and step 615 places the call table address PCLV of this call word in the accumulator and returns to ACR via terminal 613. If the call is not a zone 6 call, for example it may be an up call, the program advances to terminal 615 and step 617. Step 617 sets PCLV equal to the address of the first word of the next call in the call table and returns to step 611. This cycling continues until either a zone 6 call is found, which is placed in the accumulator by step 615, or all calls are tested and no zone 6 call is found, which results in step 612 placing zeros in the accumulator.

Step 618 (FIG. 23A) checks to see if a zone 6 call was found. If a zone 6 call was found it must now be tested to see if it timed out, since we are looking for a timed out zone 6 call. Step 619 performs this function, and if the call is not timed out the program returns to terminal 616 of subroutine LOOK which advances to the next call of the call table to continue the search for a timed out zone 6 call. If the call is timed out the program advances to step 620 to see if the call has already been assigned. If it has, the program returns to terminal 615 of subroutine LOOK to examine the next call in the call table, as a car will already be in the process of answering an assigned call.

If step 620 finds that the call is not assigned, the floor of the zone 6 call found is made the reference floor REFLR in step 621. Step 622 then looks for the closest car to this floor which is in service, available according to the dispatcher (AVAD), and not assigned ($\overline{ASG}$). Step 623 determines if such a car was found, and if not the program ACR returns to the priority executive via terminal 604. If a car was found, step 624 sets OCRNO to the car number of the car found. OCRNO is the car number to which an assignment is to be made. Step 625 provides the binary address of the call floor, which will be output to the car in question as signal FAD0-FAD6, and step 626 outputs the car assignment including the floor address assignment mode MOD0, MOD1 and service assignment SASS.

If step 606 does not find a timed out demand in zone 6, or step 618 does not find a zone 6 call, or if a zone 6 call is found and step 623 finds a car to assign to the call, the program advances to step 627.

Step 627 checks bit 4 of TODEM for a timed out demand in the low zone up, i.e., zone 4, using the convention of FIG. 15. If bit 4 of TODEM is set, step 628 then checks bit 4 of DEMIND to determine if a car has already been assigned to zone 4. When a car is assigned to a demand, the demand is removed from DEMIND, but until the timed out call in the demand zone is answered, it will persist in TODEM. Thus, if in checking TODEM in step 627 a zone 4 timed out demand is found, step 628 is necessary to see if a car has been previously assigned to this demand. If DEMIND shows a zone 4 demand then step 629 finds the lowest up call in zone 4, and then looks for the closest in service car which is AVAD and $\overline{ASG}$. If a car is found for this call, the assignment is made to the car and the program advances to terminal 630. If a car was not found, the program goes back to the priority executive via terminal 604.

If step 627 does not find a timed out demand in zone 4, or if one is found and step 628 does not find a demand in zone 4, the program also advances to terminal 630.

From terminal 630, step 631 checks bit 5 of TODEM for a timed out demand in the high zone (zone 5). Finding a zone 5 timed out demand, step 632 checks to see if a car has already been assigned to zone 5. If step 632 finds that a car has not been assigned to a demand in zone 5, step 633 finds the lowest up call in zone 5, finds the closest in service car which is AVAD and $\overline{ASG}$, and outputs the assignment. If a call is not found in step 633, or if a car is found, the program advances to terminal 634 (FIG. 23B). If a call is found but a car is not found, the program returns to the priority executive via terminal 604. If a timed out demand in zone 5 is not found, or if one is found and a demand for zone 5 is not found in DEMIND, the program advances to terminal 634.

From terminal 634, the program advances to step 635 which checks bit 6 of DEMIND for a zone 6 demand. Finding such a demand, step 636 finds the call and a car for the call if possible, advancing to terminal 604 and to the priority executive if a call is found but no car, and to step 637 if it cannot find a zone 6 call. The program also advances to step 637 if step 635 fails to find a zone 6 demand.

Step 637 checks bit 2 of DEMIND for a main floor demand. Finding such a demand, step 638 checks bit 2 of DEMAS to see if a car has already been assigned to a main floor demand. If bit 2 of DEMAS is not set, step 639 checks indicator LOBMZD to see if an AVAD car has been assigned to zone 6, the main zone down. If LOBMZD is not set, an AVAD car has not been assigned zone 6, and step 640 sets the reference floor REFLR to the main floor. Step 641 tries to locate the closest available car, and finding such a car, as determined by step 642, step 643 outputs the main floor assignment. Step 644 sets bit 2 of DEMAS to indicate a car has been assigned to the main floor demand, and indicator LOBMED is reset. If step 641 fails to find a car, as noted in step 642, the program returns to the priority executive via terminal 604. If step 637 fails to find a demand for the main floor, or if it does and DEMAS indicates a car has already been assigned to the main floor demand, the program advances to step 645. If indicator LOBMZD is set (step 639) or a car is found (step 642), the program advances to step 646.

Step 645 resets LOBMZD, and advances to step 646. Step 646 checks bit 1 of DEMIND for a basement demand, and finding such a demand attempts to find a car for the basement in step 647. If a car is not found, the program returns to the priority executive via terminal 604. If a car is found, the program advances to step 648.

Step 648 checks bit 4 of DEMIND for a demand in the low zone up, zone 4. Finding such a demand, step 649 locates the lowest up call of zone 4 and attempts to assign a car to it. If step 649 fails to find a car, the program returns to the priority executive via terminal 604. If a car is found, or if a zone 4 call cannot be located, the program advances to step 650. Step 650 checks bit 5 of DEMIND for a zone 5 demand. Finding such a demand, step 651 finds the lowest up call in zone 5, attempts to assign a car to the call, and returns to the priority executive via terminal 604. If step 650 does not find a zone 5 demand, the program returns to the priority executive via terminal 604.

Program Listing One

The attached program listing is a complete software program embodying the teachings of the invention. The program strategy in this program listing, except as modified, changed or improved by this, or the co-pending applications set forth under the heading "Cross-Reference to Related Applications" follows that disclosed in U.S. Pat. No. 3,292,736 and /or U.S. Pat. No. 3,256,958, which are assigned to the same assignee as the present application.

In summary, there has been disclosed a new and improved elevator system which uses a programmable dispatcher, including a digital computer, for dispatching and controlling the movement of a plurality of elevator cars in an associated structure. The digital computer includes a memory with a program stored therein which allocates calls to cars already in the process of serving calls for elevator service and assigns available cars to calls which cannot be so allocated. The program is divided into subprograms which separate bookkeeping and strategy functions, and runs the programs in different loops, depending upon which programs are bidding to run, and the relative priorities assigned to the programs which are bidding to run. This arrangement prevents unnecessary running of subprograms, and also makes it possible to change strategy without modifying the bookkeeping portion of the program.

I claim as my invention:

1. An elevator system comprising:

a structure having a plurality of landings, elevator cars mounted for movement relative to the structure to serve the landings, first call means for registering landing calls for elevator service from said plurality of landings, and providing serial call signals in response thereto, second call means for registering car calls from said elevator cars, control means associated with each of said elevator cars, each of saic control means controlling the operation of its associated car in response to control signals applied thereto, said control means providing serial data signals including signals indicating car position, travel and service direction and signals which indicate whether the car is in the process of serving a call, a digital computer responsive to the serial signals of said first call means and to the serial data signals provided by the control means for each of said elevator cars, said digital computer including a memory and a program stored therein for allocating landing calls and assigning tasks to the elevator cars according to predetermined strategy, said digital computer providing serial control signals for said control means which signals control the operation of said elevator cars, said program being divided into predetermined subsections, first means indicating the need to run predetermined subsections of the program in response to the serial call signals provided by said first call means and the serial data signals provided by the control means of said elevator cars, and second means serially running the subsections of the program which have a need to run, with their sequence being selected by said second means.

2. The elevator system of claim 1 wherein the first means detects events occurring in the elevator system which require action by the digital computer, and wherein the first means includes means responsive to the detected events for providing signals for the digital computer which identify the type of event.

3. The elevator system of claim 1 wherein the first means includes a portion of the program which prepares data records and compares successive data records to determine which subsections of the program have a need to run.

4. The elevator system of claim 1 wherein at least certain of the subsections of the program have a predetermined priority rating associated therewith, with the second means running the subsections of the program which have a need to run according to their relative priority ratings.

5. The elevator system of claim 1 wherein at least certain of the subsections of the program have a predetermined priority rating associated therewith, the first means includes means for placing those subsections of the program having a need to run into bid, and the second means runs the subsections placed into bid according to their relative priorities.

6. The elevator system of claim 1 wherein the program includes:

a first subsection comprising instructions for reading and storing the data signals provided by the control means of each of said elevator cars, a second subsection comprising instructions for reading the signals provided by the first call means and providing a call record by storing new landing calls and cancelling landing calls which have been answered, a third subsection comprising instructions for allocating landing calls to elevator cars which are already in the process of serving a call, for providing control signals for the control means of an elevator car selected to answer an allocated call, and for creating a demand when a landing call cannot be so allocated, a fourth subsection comprising instructions for assigning elevator cars which are not in the process of serving a call to demands created by said third subsection, and for providing control signals for the control means of an elevator car selected to answer a demand, said first, second, third and fourth subsections each having a different priority rating, and wherein the first means places the subsections into bid when they have a need to run and the second means runs the subsections placed into bid, with their running sequence being determined by their priority ratings.

7. The elevator system of claim 6 wherein the second means is a subsection of the program, which includes instructions for selecting and running only the subsection of the program having the highest priority rating of those placed into bid.

8. The elevator system of claim 6 wherein the first means is a part of the program, including instructions in the first subsection thereof for placing the second subsection into bid, and also for placing the fourth subsection into bid when there is a demand created by the third subsection with at least one elevator car not in the process of serving a call for elevator service.

9. The elevator system of claim 6 wherein the second subsection places the third subsection into bid, and the third and fourth subsections each place the first subsection into bid, resulting in first and second alternative program flow loops, including the first, second and third subsections in the first loop, while excluding the fourth subsection, and including the first, second, third and fourth subsections in the second loop.

10. The elevator system of claim 6 wherein the first subsection includes instructions for detecting the need to reallocate at least certain of the landing calls, and the third subsection includes instructions for recognizing the need for allocation detected by the first subsection and for reallocating at least certain of the landing calls in response thereto.

11. The elevator system of claim 10 wherein the third subsection includes instructions which reallocate all landing calls when the first subsection detects a need to reallocate a landing call.

12. The elevator system of claim 10 wherein the program includes a timer subsection and an interrupt subsection, said timer subsection having a higher priority than the first, second, third and fourth subsections, said interrupt subsection placing the timer subsection into bid at predetermined time intervals.

13. The elevator system of claim 12 wherein the interrupt subsection includes instructions for placing the first and second subsections into bid when they have not run for first and second predetermined periods of time, respectively.

14. The elevator system of claim 6 wherein the program includes a check subsection which includes instructions for checking the digital computer for proper operation, said check subsection having the lowest priority of the subsections, and being placed into bid by the third and fourth subsections.

15. The elevator system of claim 6 wherein the second subsection includes instructions for assembling a call record in response to the first call means, and for updating the call record by comparing the last reading of the first call means with the previous call record, noting new and answered calls, and changing the previous call record by adding new calls and deleting answered calls.

16. The elevator system of claim 6 wherein the control means for each elevator car provides car status words and the first subsection includes means for reading the car status words and comparing them with the previous status words to detect events which may require reallocation of landing calls, and wherein the third subsection includes instructions for processing all of the landing calls when the third subsection runs and the first subsection has detected an event requiring possible reallocation.

17. The elevator system of claim 6 wherein the third subsection includes instructions which prevent it from allocating a landing call to a car assigned to a demand until the car has answered its first call following the assignment.

18. An elevator system comprising:

a structure having a plurality of landings, elevator cars mounted for movement relative to the structure to serve the landings, first call means for registering landing calls for elevator service from said plurality of landings, and providing serial call signals in response thereto, second call means for registering car calls from said elevator cars, control means associated with each of said elevator cars, each of said control means controlling the operation of its associated car in response to control signals applied thereto, said control means providing serial data signals including signals indicating car position, travel and service direction and signals which indicate whether the car is in the process of serving a call, serial processor means, said serial processor means having a plurality of selectable means for performing a plurality of different functions, including:

first means for storing in storage means the serial data signals provided by said control means associated with each of said elevator cars, second means for storing in storage means the serial call signals provided by said first call means, third means for processing the serial data signals stored in said first and second means and determining a pattern of assignments for said elevator cars to serve the landing calls, fourth means respsonsive to the third means for providing serial control signals for the control means of said elevator cars which direct the movement and certain of the stopping locations of the elevator cars, said serial processor means also including fifth means for determining which of the plurality of selectable means have a need to operate, and sixth means responsive to said fifth means for sequentially operating the means which have a need to operate according to a predetermined priority schedule.

19. The elevator system of claim 18 wherein the first means when operated, includes means for detecting events which indicate a previously determined pattern of assignments provided by the third means for serving the landing calls may no longer be suitable, and providing a flag signal when such an event is detected, and wherein the third means is responsive to said flag signal, processing all of the floor calls stored in the second means when the flag signal is present, and only floor calls which have not yet been processed when the flag signal is not present.

20. The elevator system of claim 19 wherein the means which detects events when the first means is operated, detects the events by comparing the latest serial data signals with the serial data signals stored the last time the first means was operated.

21. The elevator system of claim 18, wherein the second means when operated, includes means comparing the latest serial call signals with those stored the last time the second means was operated, to detect new and cancelled floor calls.

22. The elevator system of claim 21 wherein the second means stores only the new floor calls detected, and removes cancelled floor calls from the storage means.

23. The elevator system of claim 18 wherein the third means includes selectable allocation means and assignment means, said allocation means attempting to allocate each landing call to an elevator car having a location and service direction which intercepts the landing call, and creating a demand signal relative to each landing call which is not so allocated, and with the assignment means attempting to assign an elevator car not busy serving a call to each landing call having a demand signal created for it by said allocation means, and wherein the fifth means determines that the assignment means has a need to run only when a demand signal has been created by the allocation means and there is an elevator car not presently serving a call.

* * * * *